US005287812A

United States Patent [19]

Lobb et al.

[11] Patent Number: 5,287,812

[45] Date of Patent: Feb. 22, 1994

[54] RAILROAD CAR POSITIONING APPARATUS

[75] Inventors: Ernest W., Lobb; Bruce A. Robbins, both of Aurora; David L. Depew, Boling Brook, all of Ill.

[73] Assignee: Svedala Industries, Inc., Waukesha, Wis.

[21] Appl. No.: 871,267

[22] Filed: Apr. 17, 1992

Related U.S. Application Data

[62] Division of Ser. No. 565,644, Aug. 10, 1990, Pat. No. 5,150,656.

[30] Foreign Application Priority Data

Sep. 28, 1989 [CA] Canada ..... 615556

[51] Int. Cl.[5] ..... B61B 13/00

[52] U.S. Cl. ..... 104/162

[58] Field of Search ..... 104/162, 165, 173.1, 104/172.3, 178, 176; 198/38.5, 41, 42, 60, 33

[56] References Cited

U.S. PATENT DOCUMENTS

| | | | |
|---|---|---|---|
| 1,522,116 | 1/1925 | Gray et al. | 104/162 |
| 2,900,922 | 8/1959 | Edmonds | 104/162 |
| 2,948,235 | 8/1960 | Stamler et al. | 104/162 |
| 2,961,973 | 11/1960 | Bozman | 104/162 |
| 3,260,220 | 7/1966 | Ludwig | 104/162 |
| 3,339,495 | 9/1967 | Wright | 104/162 |
| 3,377,961 | 4/1968 | Hunt | 104/162 |
| 3,402,677 | 9/1968 | Saxonmeyer | 104/176 |
| 3,408,953 | 11/1968 | Saxonmeyer | 104/176 |
| 3,508,499 | 4/1970 | Collins | 104/176 |
| 3,696,754 | 10/1972 | Anderson et al. | 104/162 |
| 4,170,292 | 10/1979 | Lang | 104/162 |
| 4,252,064 | 2/1981 | Ratcliff, Jr. et al. | 104/162 |
| 4,926,755 | 5/1990 | Seiford | 104/162 |

FOREIGN PATENT DOCUMENTS

| | | | |
|---|---|---|---|
| 0587780 | 10/1933 | Fed. Rep. of Germany | 104/162 |
| 0636162 | 9/1936 | Fed. Rep. of Germany | 104/162 |
| 0679852 | 7/1939 | Fed. Rep. of Germany | 104/162 |
| 0715205 | 11/1941 | Fed. Rep. of Germany | 104/162 |
| 0731997 | 1/1943 | Fed. Rep. of Germany | 104/162 |
| 0863953 | 1/1953 | Fed. Rep. of Germany | 104/162 |
| 0024540 | 1/1956 | Fed. Rep. of Germany | 104/162 |
| 0942867 | 4/1956 | Fed. Rep. of Germany | 104/162 |
| 2721313 | 11/1978 | Fed. Rep. of Germany | 104/162 |
| 3508781 | 9/1986 | Fed. Rep. of Germany | 104/162 |
| 0763022 | 4/1934 | France | 104/162 |
| 0829323 | 3/1938 | France | 104/162 |
| 1214098 | 4/1960 | France | 104/162 |
| 0131677 | 11/1978 | Japan | 104/162 |
| 0448835 | 6/1936 | United Kingdom | 104/162 |

OTHER PUBLICATIONS

Stephens-Adamson (an Allis-Chalmers Company), SCAMP System II Drawings, 1981 and 1983. (28 pages of drawings).

*Primary Examiner*—Mark T. Le

*Attorney, Agent, or Firm*—Webb, Burden, Ziesenheim & Webb

[57] ABSTRACT

A railroad car positioning apparatus for positioning a railroad car along a track. The railroad car positioning device apparatus includes a carriage member and first and second dog members mounted on the carriage member. The apparatus includes a device for positioning the dog members and for extending the dog members from the carriage member to an axle height of a railroad car for contacting one of the axles on opposite sides thereof. The apparatus further includes a plurality of hydraulic cylinders for moving the carriage member in a forward or reverse direction to acquire an axle and for exerting a force between one of the dog members and the acquired axle to position the railroad car along the track.

21 Claims, 23 Drawing Sheets

RAILROAD CAR POSITIONING APPARATUS

This is a division, of application Ser. No. 07/565,644, filed on Aug. 10, 1990 now U.S. Pat. No. 5,150,656.

BACKGROUND OF THE INVENTION

1. Field of the Invention:

The present invention relates to an apparatus for positioning a railroad car at a particular desired location along a railroad track, for example, at a loading/unloading site, at a weight scale, etc.

2. Background Information:

Devices for positioning railroad cars are generally known in the prior art. Generally, such devices have operated by exerting a pushing force or pulling force upon the railroad cars. Accordingly, such devices have not been capable of positively positioning and locking a railroad car at a particular desired location along the railroad track.

OBJECTS OF THE INVENTION

One object of the present invention is the provision of a railroad car positioning apparatus which is capable of positively positioning and locking a railroad car at a particular desired location along the railroad track.

SUMMARY OF THE INVENTION

In general, the invention features a railroad car positioning apparatus for positioning a railroad car, the railroad car having at least two axles spaced apart along a longitudinal axis of the railroad car, each of the at least two axles being provided with wheels on the opposing ends thereof, the railroad car positioning device apparatus including: a carriage member; a first dog member mounted on the carriage member and a second dog member mounted on the carriage member; a device for positioning the first dog member for extending the first dog member to at least a first position wherein the first dog member extends from the carriage member to at least the height of the axle members of the railroad car for contacting at least one of the axle members of the railroad car; a device for selectively positioning the second dog member for extending the second dog member to at least either of a first position wherein the first dog member extends from the carriage member to at least the height of the axle members of the railroad car for contacting at least one of the axle members of the railroad car, and a second position wherein the second dog member is fully disposed beneath the height of the axle members of the railroad car; and a displacement apparatus for displacing the carriage member in a direction parallel to the longitudinal axis of the railroad car and for exerting a force between at least one of the first and second dog members and at least one of the axle members of the railroad car and for thereby moving the railroad car.

BRIEF DESCRIPTION OF THE DRAWINGS

The disclosure now turns to a detailed description of a preferred embodiment of the invention, after first briefly describing the accompanying drawings, wherein:

FIGS. 1A-1C each form part of a schematic plan view of the basic components making up a railroad car positioner constructed according to the present invention, and wherein FIGS. 1A-1C are to be aligned at the ends with one another at the match lines X—X and Z—Z indicated thereon;

DESCRIPTION OF THE PREFERRED EMBODIMENTS

STRUCTURE

Figure 1A:
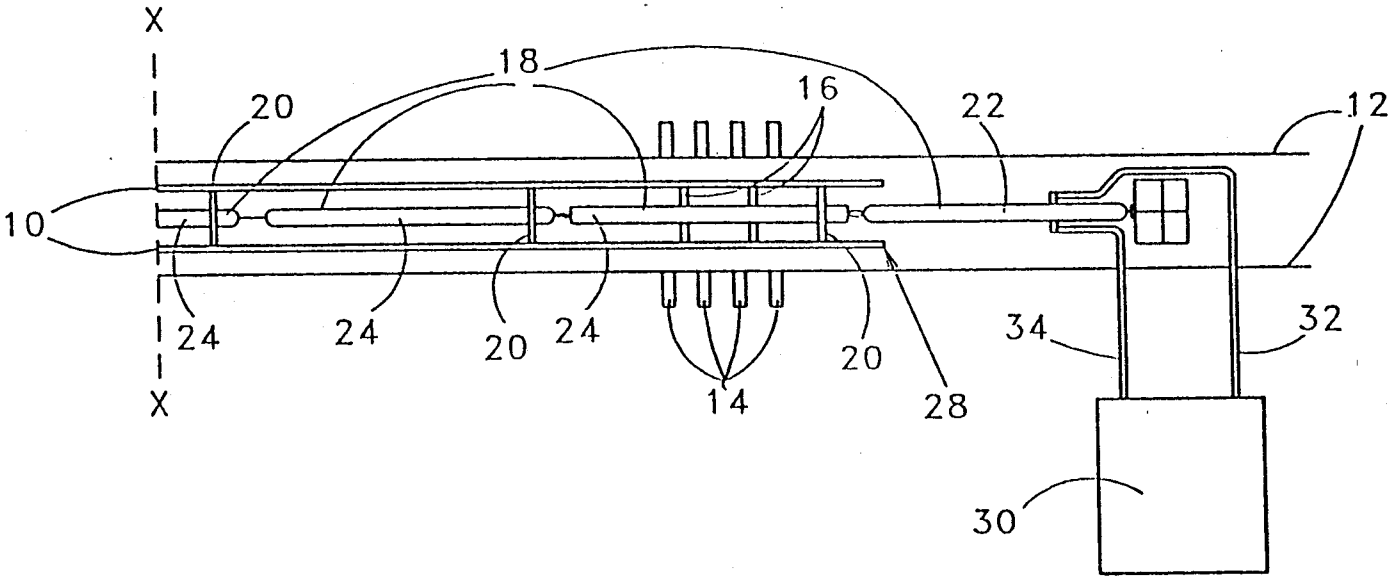

Referring first to FIG. 1A, a guide way 10, preferably consisting of two parallel guide tracks, is disposed in between and parallel to two rails 12 of a railroad track. The guide way 10 is preferably rigidly fastened to railroad ties 14. Steel ties 16 extend between and thereby brace the two parallel guide tracks of the guideway 10. Preferably, the steel ties 16 are oriented parallel to the railroad ties 14, and one steel tie 16 is located between every second pair of adjacent railroad ties 14.

A series of hydraulic cylinders 18 is disposed between the guide tracks of the guide way 10. The longitudinal axis of the cylinders 18 is preferably oriented parallel with and midway between the guide tracks of the guide way 10. Guide roller brackets 20, which span the width of the guide way 10, are provided for supporting the hydraulic cylinders 18. The guide roller brackets 20 are preferably equipped with rollers 70 (see FIG. 2) which are set into and ride within recesses provided in the parallel guide tracks of the guide way 10. The series of hydraulic cylinders preferably includes a first cylinder 22 and a last cylinder 26 (See FIG. 1B). Additionally, the series of hydraulic cylinders 18 may also include at least one cylinder 24, preferably five in number, disposed in series between the first cylinder 22 and the last cylinder 26.

One end of the guide way 10, as shown in FIG. 1A, is designated as being the reverse travel end 28. At the reverse travel end 28 of the guide way 10, a hydraulic power unit 30 is disposed, preferably alongside and outside of the rails 12 of the railroad track. The hydraulic power unit 30 is provided with connecting hoses 32 and 34 which place it in fluid communication with the first hydraulic cylinder 22.

The hydraulic power unit 30, which may be a commercially available component, includes an electric motor driving a fluid pressurizing pump, valves to route the pressurized fluid to either of the connecting hoses 32 or 34, pressure and flow control elements, and hydraulic fluid filters, all mounted on a fluid reservoir of suitable volume. Such hydraulic power units are well known in the art. An example of a similar hydraulic power unit may be found in U.S. Pat. No. 4,570,661, issued on Feb. 18, 1986 to Neale A. Chaplin.

Figure 1B:
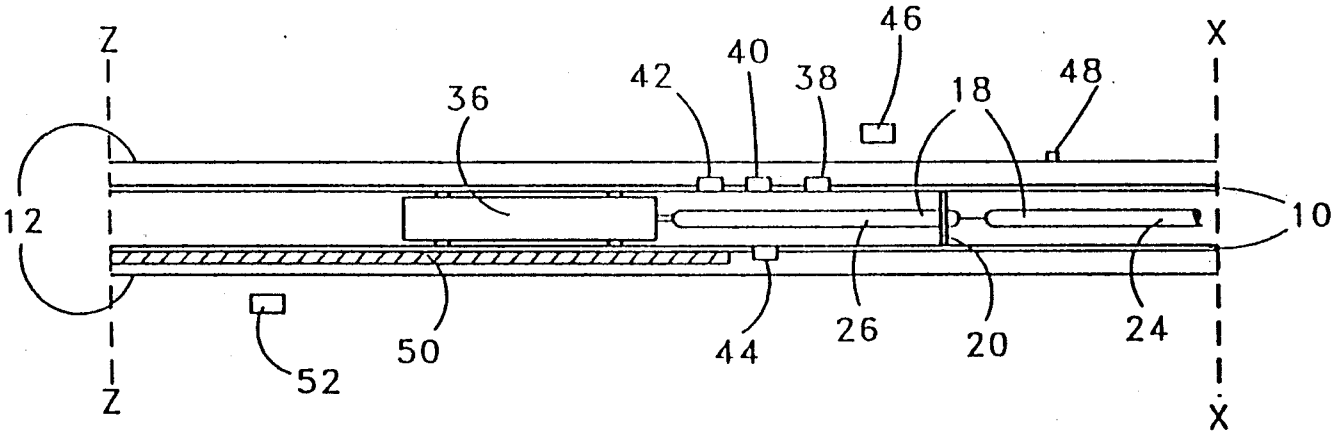

As shown in FIG. 1B, connected to the last hydraulic cylinder 26 in the series of cylinders 18, there is disposed a carriage assembly 36. The carriage assembly 36 is preferably in the form of a rectangular structure and is disposed between the guide tracks of the guide way 10. The carriage assembly 36 is equipped with wheels 78 and 82 (See FIG. 4) which ride within recesses provided within the guide tracks of the guide way 10. Disposed on the guide tracks of the guide way 10 are a set of limit switches 38–44. More particularly, on one side of the guide way 10, progressing away from the direction of the reverse travel end 28 of the guide way 10 (as shown in FIG. 1A), an end travel limit switch 38, a wheel detector limit switch 40, and a creep limit switch 42 are preferably disposed. Directly opposite this series of three switches 38–42, on the other side of the guide way 10, a wheel clear limit switch 44 is located. A power cable junction box 46, to which power cables are connected from other parts of the apparatus, is preferably located outside of the rails 12 of the railroad track, in the vicinity of the limit switches 38, 40 and 42. One preferred embodiment of the invention includes a retractable wheel stop 48, located on one rail 12, between the end travel limit switch 38 and the reverse travel end 28 (as shown in FIG. 1A) of the guide way 10. Preferably, the apparatus according to the invention further includes a cable tray 50 disposed parallel to and in between one guide track of the guide way 10 and one rail 12. Another power cable junction box 52, to which power cables are connected from other parts of the apparatus, is preferably located outside of the rails 12 near the midpoint of the length of the cable tray 50.

Figure 1C:
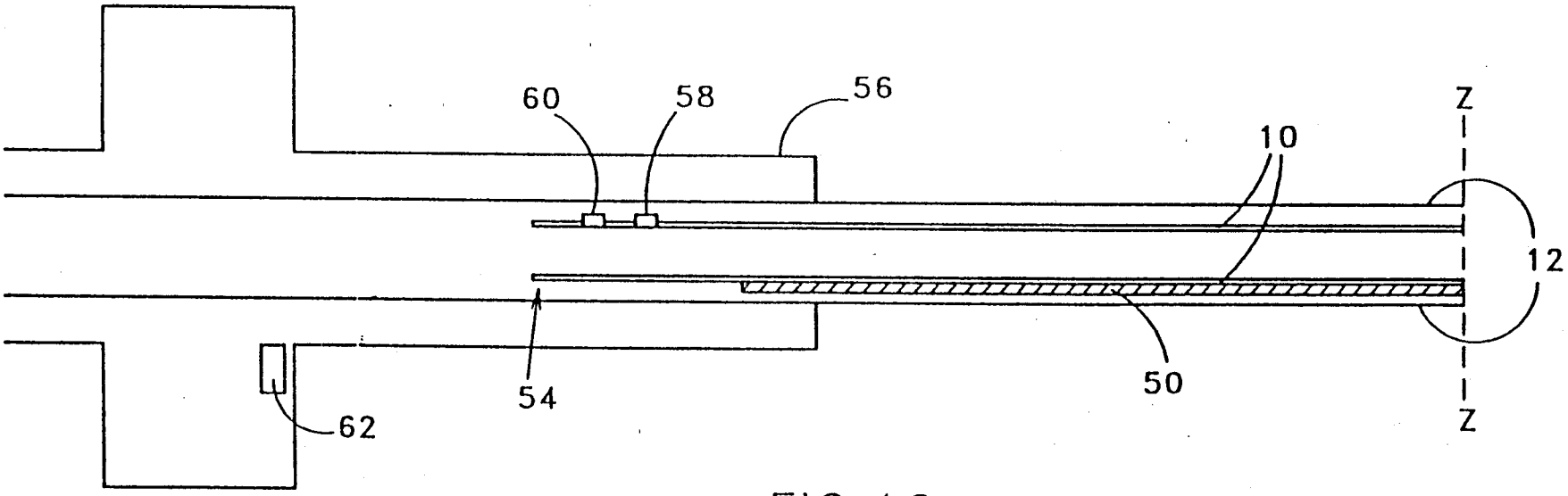

Referring now to FIG. 1C, the end of the guide way 10 shown there will be referred to herein as the forward travel end 54 of the guide way 10. The forward travel end 54 of the guideway 10 is preferably located in a railroad car loading shed 56. Towards the forward travel end 54 of the guide way 10, a creep limit switch 58 and an end travel limit switch 60 are preferably located. Additionally, an operator's panel 62, which has connectors which preferably control the entire apparatus, may be located as shown near the forward travel end 54 of the guide way 10.

Figure 2:
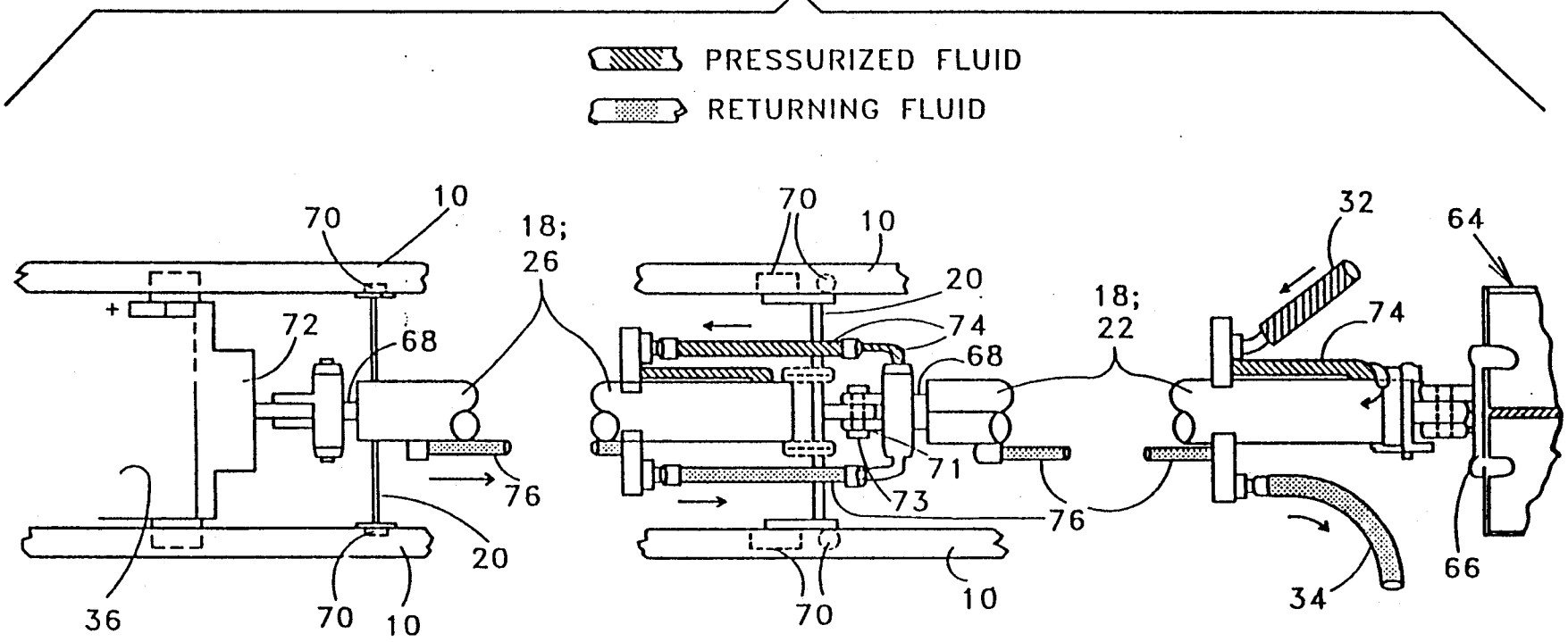
FIG. 2 is a partial plan view of a linear system of hydraulic power cylinders, which also depicts the flow of hydraulic fluid required for forward motion of a carriage assembly disposed at the end of the system of cylinders.
Figure 3:
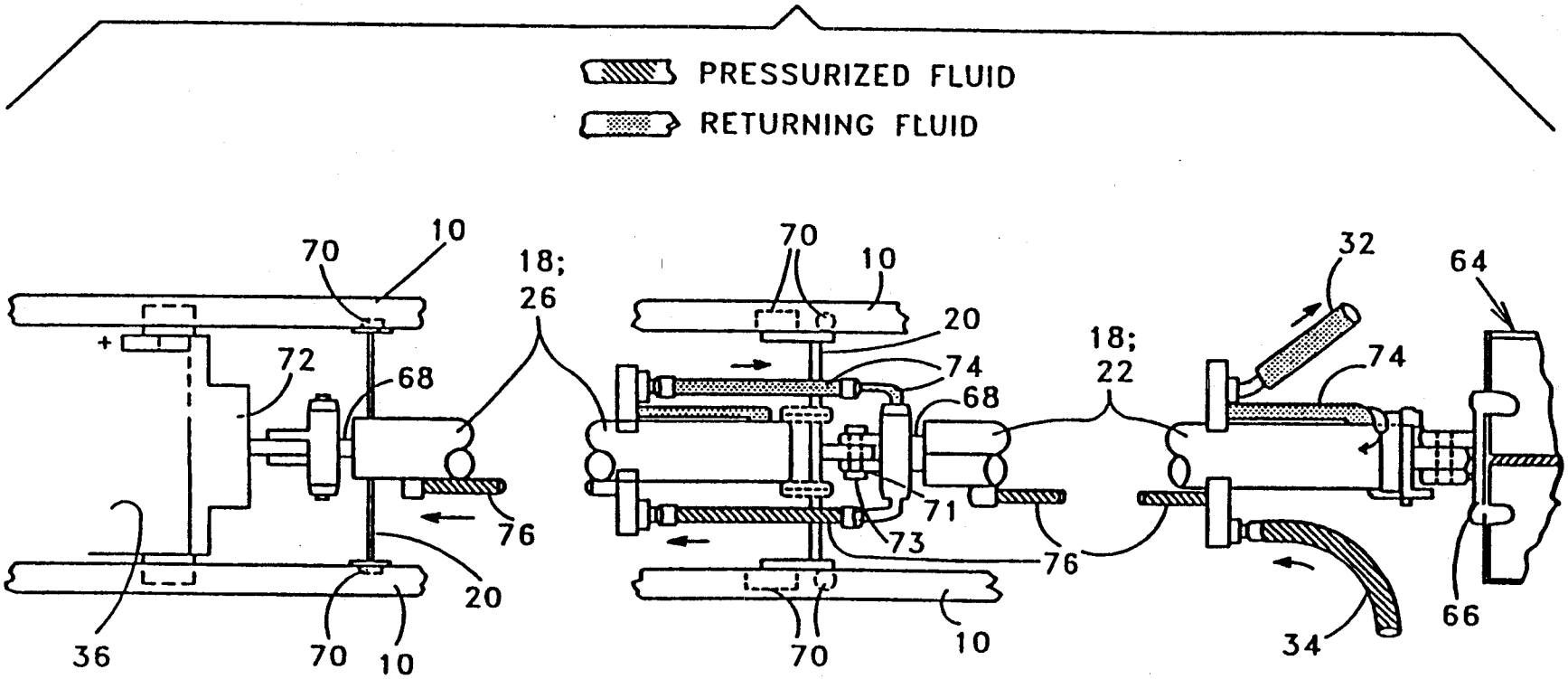
FIG. 3 is substantially the same view as FIG. 2, but which also depicts the flow of hydraulic fluid required for reverse motion of the carriage assembly.

FIGS. 2 and 3 provide a more detailed view of the series of hydraulic cylinders 18. A fixed anchor plate 64, disposed between the railroad track rails 12, has a connection bracket 66 on which the first hydraulic cylinder 22, herein referred to as the anchor hydraulic cylinder, is pin-mounted. Preferably, originating from an intermediate point along the anchor hydraulic cylinder 22 are the hydraulic fluid connections 32 and 34 leading to the hydraulic power source 30 shown in FIG. 1A. The anchor hydraulic cylinder 22, as well as the other cylinders 18, is provided with a piston rod 68.

Preferably, connected in series with the anchor hydraulic cylinder 22, is at least one other hydraulic cylinder 26 of similar construction. The anchor hydraulic cylinder 22 and the at least one other hydraulic cylinder 26, are preferably interconnected by means of provided guide roller brackets 20, which brackets have holes 71 with pins 73 inserted therein. The roller brackets 20 span the width of the guide way 10 and preferably include horizontal and vertical rollers 70 on either side. The rollers 70 are set into the recesses of the guide way 10 in order to permit longitudinal movement of the series of cylinders 18 within the rails 12 (See FIG. 1A). The at least one other hydraulic cylinder 18 is also provided with a piston rod 68.

In an embodiment wherein more than two hydraulic cylinders 18 are employed, the cylinder located furthest from the anchor cylinder 22 is the last cylinder. For purposes of illustration, this last cylinder will be herein referred to as the carriage cylinder 26. The carriage cylinder 26 is preferably connected to a previous intermediate cylinder 24 by means of one of the guide roller brackets 20 (see FIG. 1B). Additionally, the carriage cylinder 26 is preferably connected to the carriage assembly 36 by being pin-mounted on a bracket 72.

The system of piping for transporting hydraulic fluid for the extension and retraction of the hydraulic cylinders 18 is also illustrated in FIGS. 2 and 3. As used herein, the "blind end" of each hydraulic cylinder 18 shall be defined as that end located or oriented towards the anchor plate 64. Likewise, the "rod end" of each hydraulic cylinder 18 shall be defined as that end located or oriented towards the carriage assembly 36.

The blind end fluid connection 32 and the rod end fluid connection 34 are routed from the hydraulic fluid source 30 to the anchor cylinder 22. On one side of the series of cylinders 18, a series of blind end hoses 74 distributes hydraulic fluid to the blind end of each hydraulic cylinder 18. Likewise, a set of rod end hoses 76, along the opposite side of the cylinders 18, delivers hydraulic fluid to the rod end, that is, the end where the rod emerges, of each cylinder 18.

FIG. 2 illustrates the hydraulic fluid flow which actuates forward motion, which motion is defined in the drawing, by means of the delivery of pressurized hydraulic fluid through the blind end hoses 74 and the return of fluid through the rod end hoses 76. Conversely, FIG. 3 illustrates the actuation of reverse motion, which motion is also defined by an arrow in the drawing, by means of the delivery of pressurized fluid through the rod end hoses 76 and the return of fluid through the blind end hoses 74.

Figure 4:
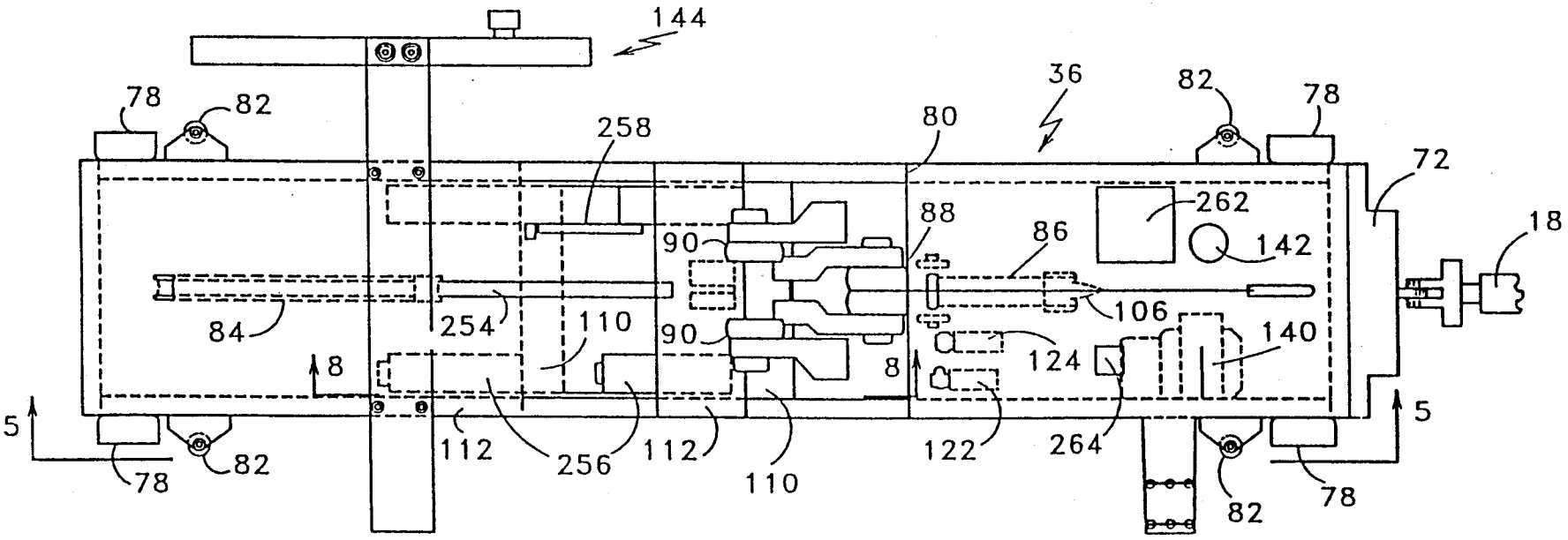
FIG. 4 is a plan view of a carriage assembly utilized in the present invention, wherein axle dogs provided thereon are shown in a fully raised position, and wherein a lock bar provided thereon is shown in a locking position.

Referring now to FIG. 4, the carriage assembly 36 includes a structural frame supported by four preferably vertically mounted wheels 78, for movement along the guide way 10 (See FIG. 1B). One wheel 78 is positioned at each end of provided carriage side bars 80. The side bars 80 also bear thereon four additional horizontally mounted wheels 82, for guidance of the carriage within the guide way 10, wherein one horizontal wheel 82 is mounted adjacent to each wheel 78. As used herein, the forward end of the carriage assembly 36 shall be defined as that end lacking an interconnecting hydraulic cylinder 18. Likewise, the reverse end of the carriage assembly 36 shall be defined as that end to which a hydraulic cylinder 18 is interconnected. It will be understood that the "forward end" and "reverse end" of the carriage assembly 36 are correspondingly oriented towards the forward travel end 54 and the reverse travel end 28, respectively, of the guide way 10 (as shown in FIGS. 1C and 1A, respectively).

On the frame of the carriage assembly 36 are pusher dogs 88 and 90, as shown in FIGS. 4–8, which dogs are preferably mounted on a single axle. The single axle pusher dogs consist of a pair of forward dogs 88 and a pair of reverse dogs 90.

Figure 5:
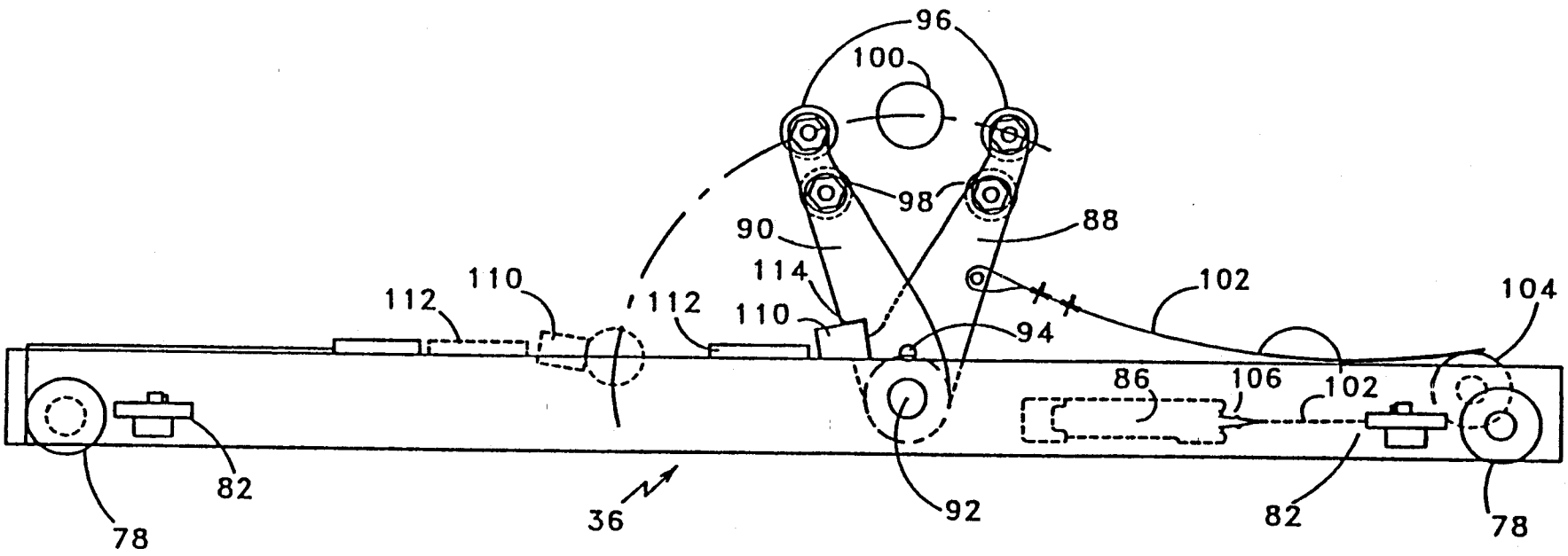
FIG. 5 is an elevational view of the carriage assembly of FIG. 4, taken along the line V—V, wherein the axle dogs are shown in their fully raised position.

As shown in FIG. 5, both pairs of dogs 88 and 90 are pivotally mounted to the carriage assembly 36 near the center thereof by means of a rod 92, and are disposed to pivot about this rod 92. Additionally, a holding pin 94 is disposed above the rod 92, which interconnects the dogs 88 and 90 in such a way that it causes the forward dogs 88 to pivot independently of the reverse dogs 90 up to a certain angle of separation between the forward dogs 88 and the reverse dogs 90, this aspect of the invention being discussed more fully below. The extending end of each of the forward dogs 88 and the reverse dogs 90 is preferably equipped with a rotatably mounted upper roller 96 and lower roller 98.

In FIG. 5, the dogs 88 and 90 are shown in a fully raised position, flanking a railcar axle 100. As shown, a cable 102 runs from an intermediate point along the forward dogs 88, around a guide wheel 104 mounted on the reverse end of the carriage assembly 36, and hence to a piston rod 106 of a reverse end hydraulic cylinder 86. The piston rod 106 and hydraulic cylinder 86 are preferably mounted within the carriage frame between the axle dogs 88 and 90 and the guide wheel 104.

Figure 6:
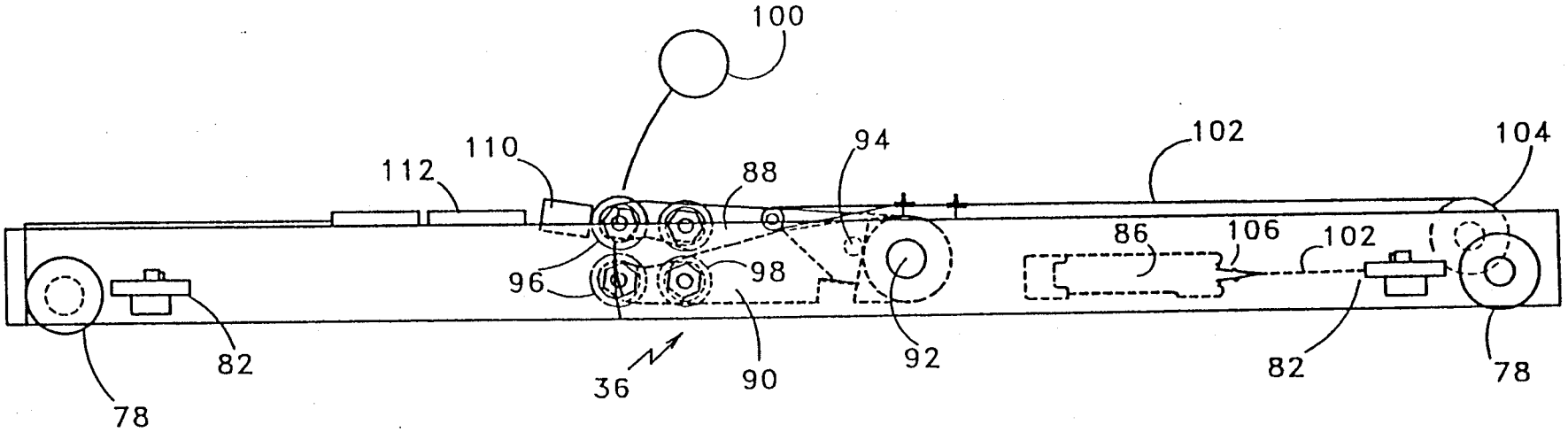
FIG. 6 is substantially the same view as FIG. 3, but showing the carriage assembly with the axle dogs in a fully lowered position, and also showing the lock bar in a retracted position.

In FIG. 6, the axle pusher dogs 88 and 90 are shown in a fully lowered position within the carriage assembly 36. In this position, the reverse dogs 90 lie substantially horizontally along the bottom of the carriage assembly 36 and the forward dogs 88 lie collapsed on top of the reverse dogs 90. In other words, the forward dogs 88 and the reverse dogs 90 are only minimally separated from each other and occupy a relatively compact space within the structure of the carriage assembly 36. This compact arrangement of the dogs 88 and 90 gives the carriage assembly 36 a very low profile, thereby allowing for free, unhindered passage of the carriage assembly 36 below the railroad car axles 100 and any protruding railroad car hopper attachments which may be present in the working environment.

Figure 7:
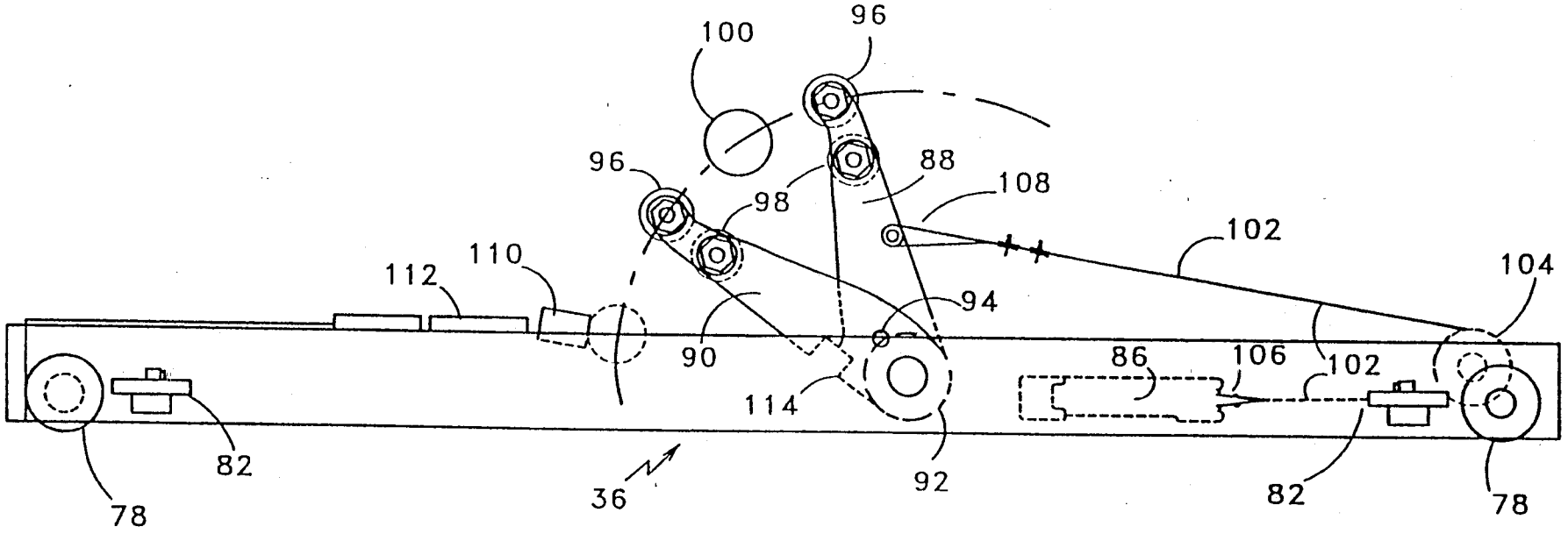
FIG. 7 is substantially the same view as FIGS. 5 and 6, but showing the carriage assembly with the axle dogs in an intermediate position between the fully raised and fully lowered positions of FIGS. 5 and 6, respectively.

In FIG. 7, the axle pusher dogs 88 and 90 are shown in an intermediate position, in which the dogs 88 and 90 are not fully raised. It may be seen that, in this position, the forward dogs 88 are preferably at a level substantially as high as or slightly above the axle 100 and the reverse dogs 90 are preferably at a level below that of the axle 100.

Figure 8:
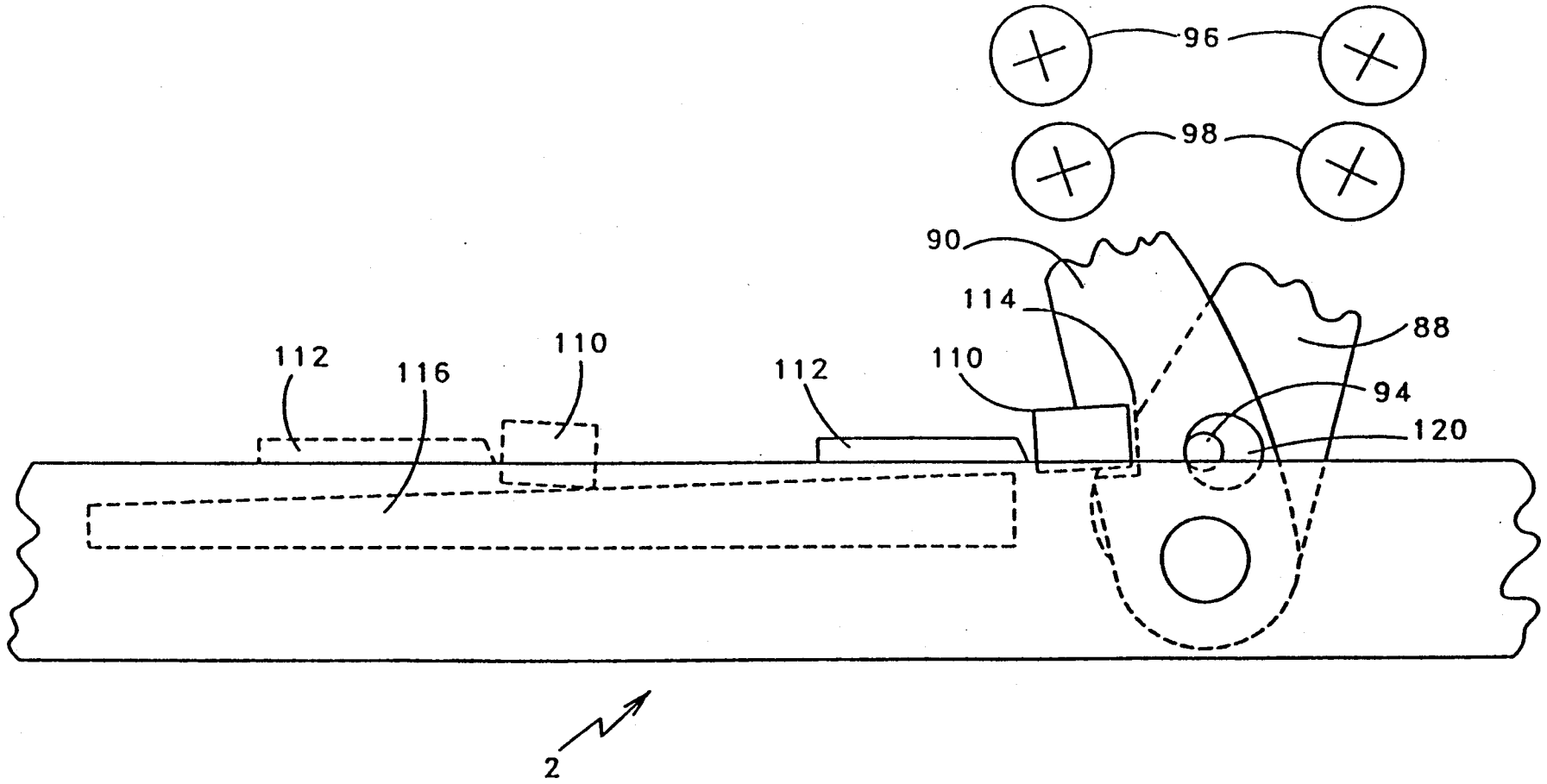
FIG. 8 is a sectional elevational view taken along the line VIII—VIII of FIG. 4.
Figure 11:
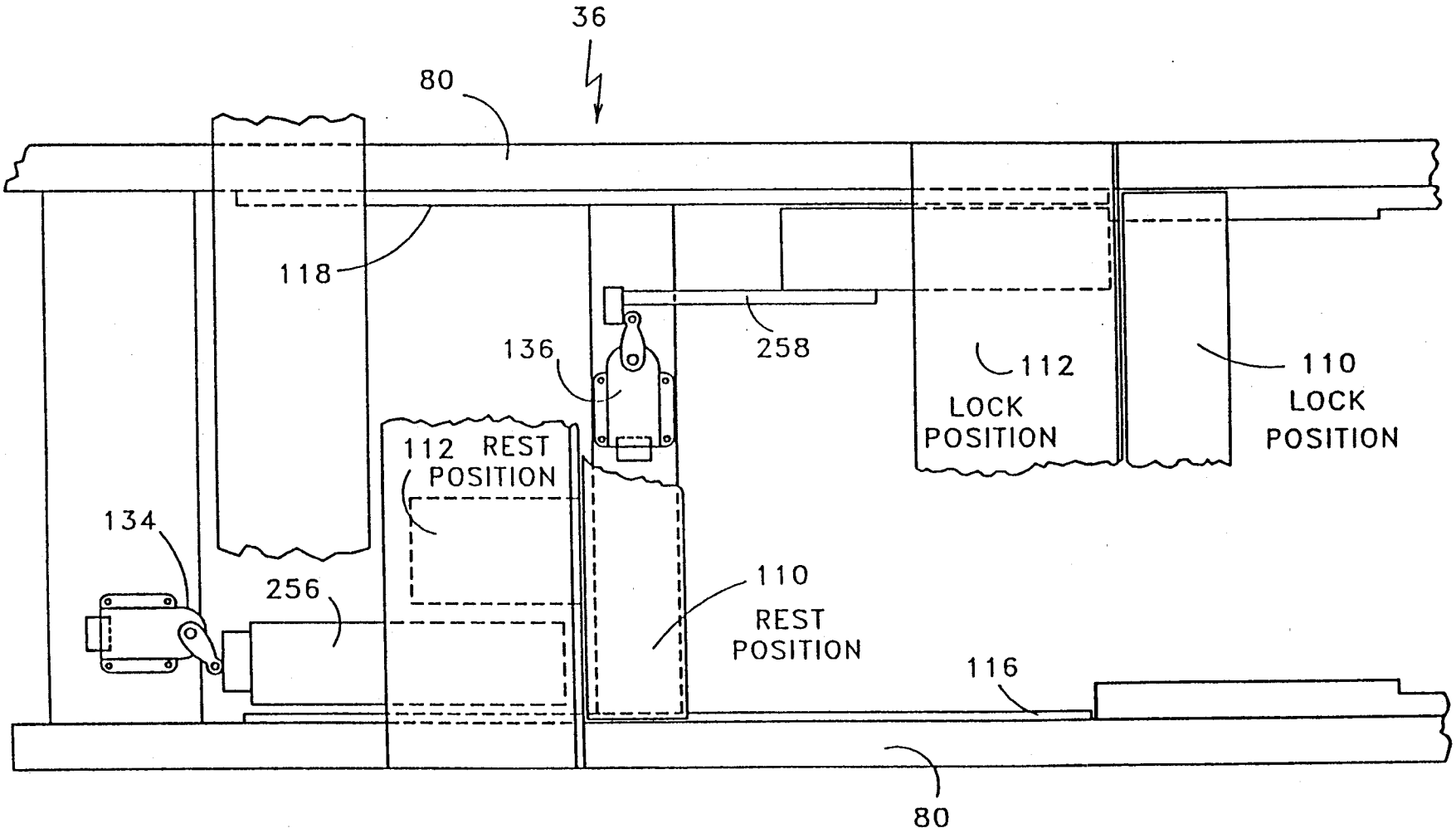
FIG. 11 is an enlarged plan view of a front portion of the carriage assembly, showing in detail a set of lock bar position sensors.

FIG. 8 is an enlarged elevational view, wherein the dogs 88 and 90 are shown again in their fully raised position. Also illustrated in FIG. 8 is a preferred arrangement of a lock bar 110 and a locking slide 112 connected to the cylinder 84, as shown in FIG. 4. The lock bar 110, sitting in a notch 114 at the base of the reverse dogs 90, supports the dogs 88 and 90 while the dogs 88 and 90 are in their fully raised position. When the dogs 88 and 90 are not in the fully raised position illustrated in FIG. 8, the lock bar 110 is disposed in a horizontal position some distance away from the dogs 88 and 90. A ramp 116 is provided on the carriage assembly 36, which is preferably located alongside one side thereof and which is situated so as to guide the movement of the lock bar 110. As shown in FIG. 11, a substantially similar ramp 118 is disposed substantially opposite the ramp 116 and on the opposite side of the carriage assembly 36.

FIG. 8 also shows, in greater detail, the interconnection between the forward dogs 88 and the reverse dogs 90. As shown, the holding pin 94 is disposed within a hole 120. The hole 120 passes through both pairs of dogs 88 and 90 and is of a greater diameter than that of the holding pin 94. As discussed more fully below, this construction permits first the raising of the forward dog 88, followed by a subsequent raising of the reverse dog 90.

Figure 9:
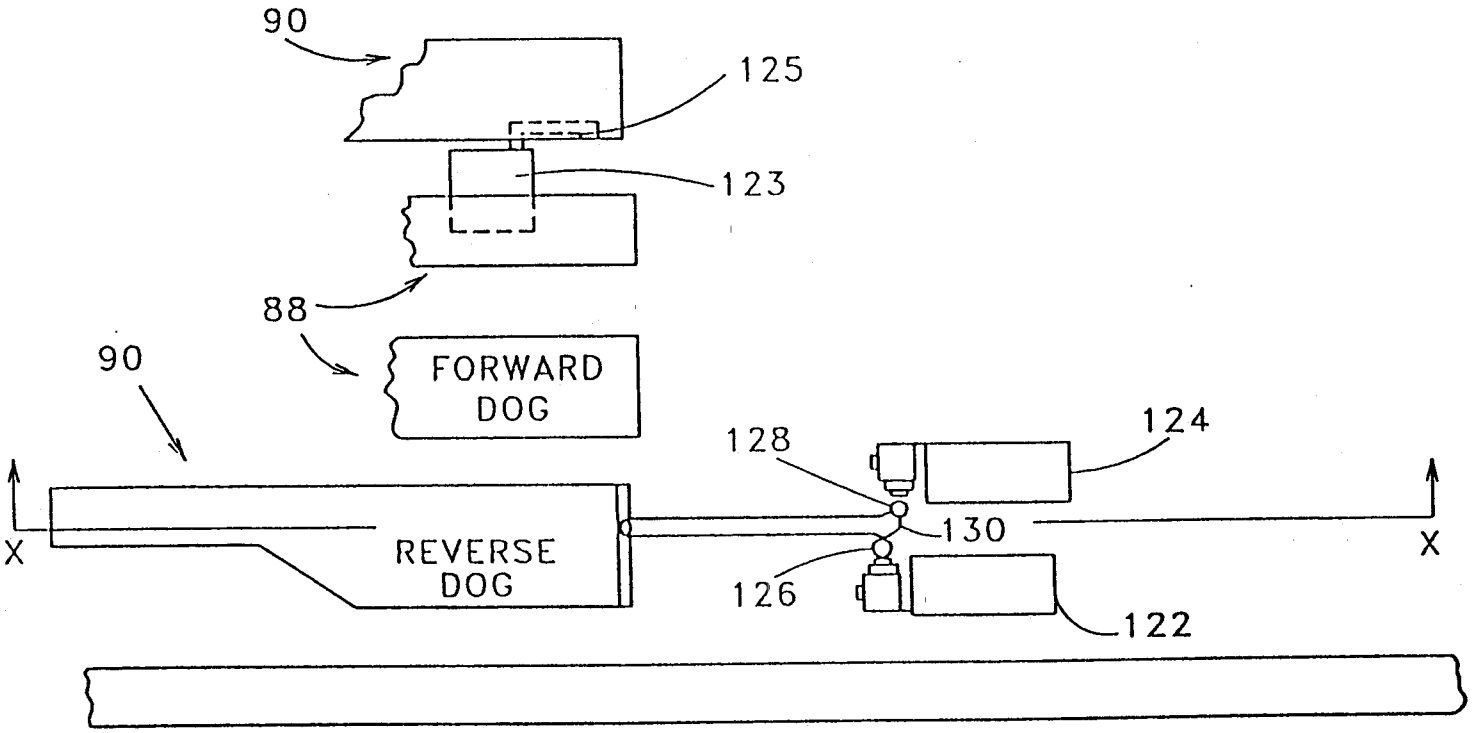
FIG. 9 is an enlarged plan view of a rear portion of the carriage assembly, showing in detail a set of axle dog position sensors.

Referring now to FIG. 9, position limit switches 122, 123 and 124 are preferably provided for determining the position of the axle dogs 88 and 90, along with associated side push rollers 126 and 128 and lever 125. A plunger 130 is positioned between the limit switches 122 and 124 and the lower end of one of the reverse dogs 90.

Figure 10:
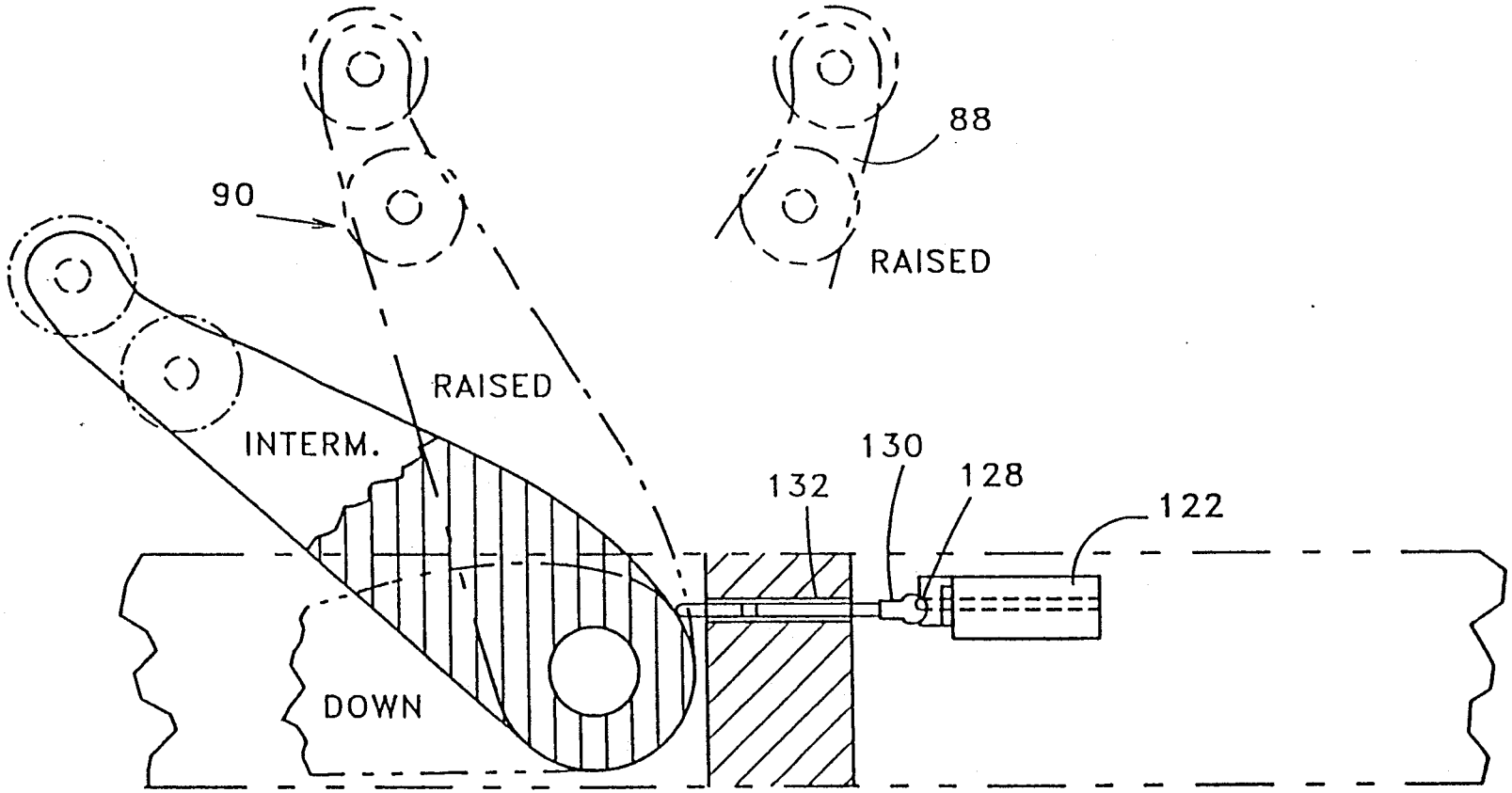
FIG. 10 is an enlarged partial sectional, elevational view taken along the line X—X of FIG. 9.

FIG. 10 shows, in elevational view, the plunger 130, one side push roller 128 and one limit switch 122. It will be seen that the plunger 130 is disposed to displace longitudinally within a sleeve bearing 132.

As shown in FIG. 11, position limit switches 134 and 136 are preferably provided for determining the position of the lock bar 110. The limit switches 134 and 136 are positioned on the carriage assembly 36, directly underneath the level of the path of travel of the lock bar 110.

Figure 12:
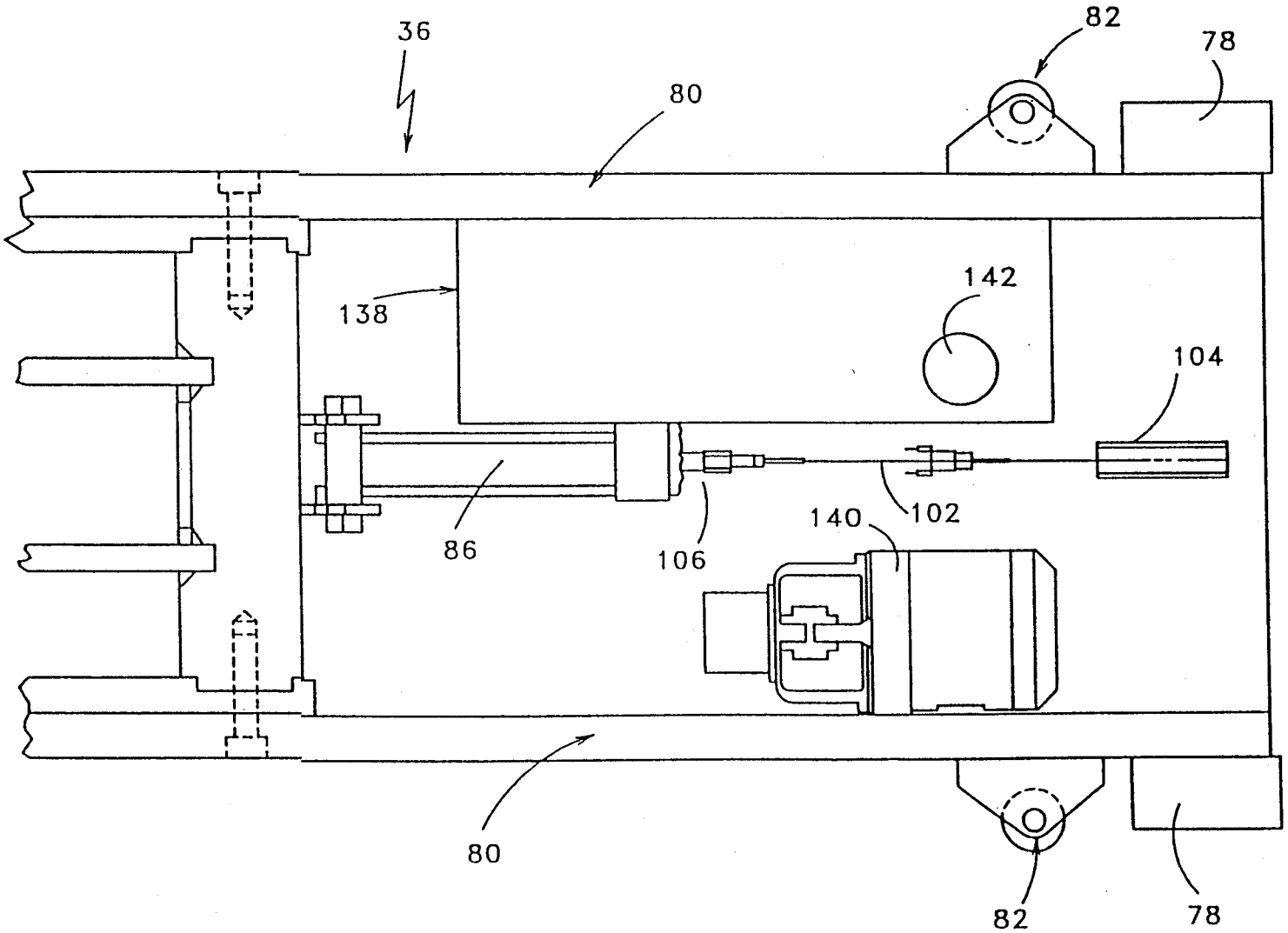
FIG. 12 is an enlarged plan view of a rear portion of the carriage assembly, showing a hydraulic pump and a hydraulic reservoir provided thereon.

FIG. 12 shows a hydraulic fluid reservoir 138 and a fluid pump 140, preferably positioned at the reverse end of the carriage assembly 36. The pump 140 is used for pumping and extracting the hydraulic fluid between the reservoir 138 and the cylinders 86 and 84 as shown in FIG. 4. A fill cap 142, which is disposed atop the reservoir 138, is provided for the addition of hydraulic fluid to the reservoir 138.

Figure 13:
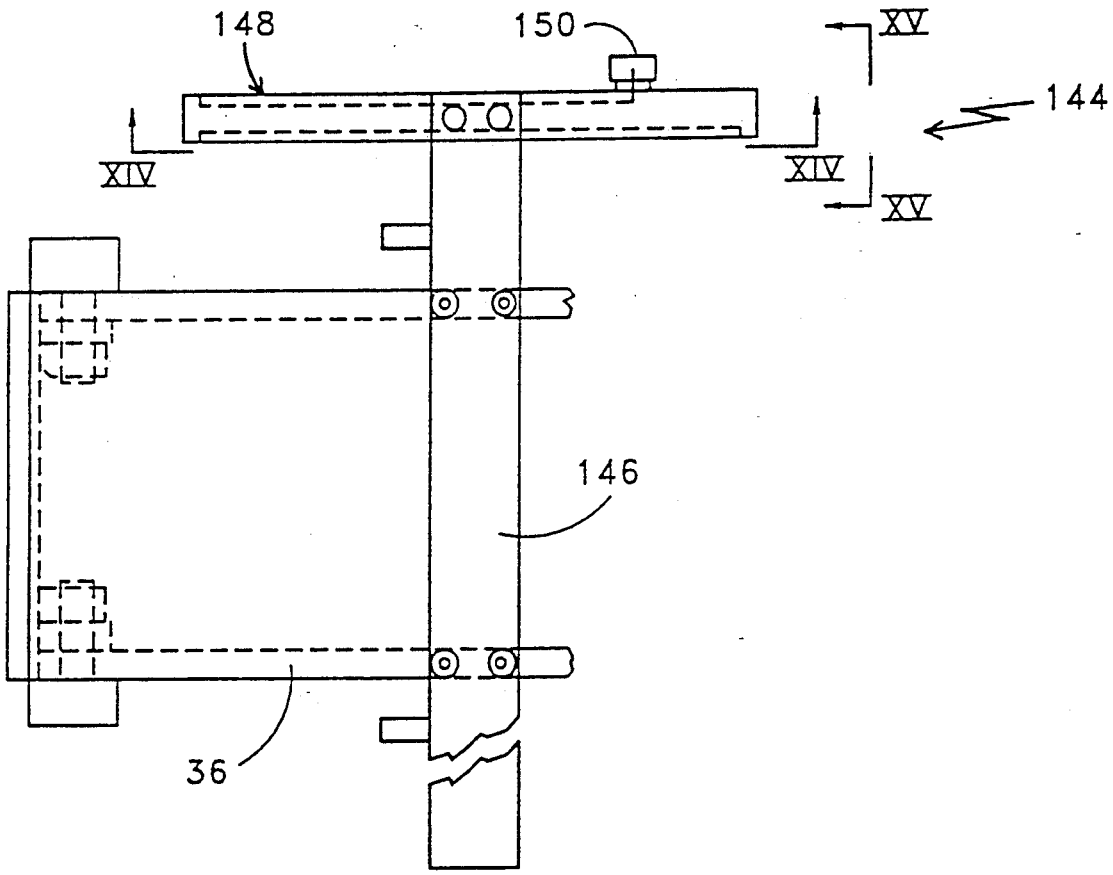
FIG. 13 is a plan view of a front portion of the carriage assembly, showing a wheel counting assembly provided thereon.

As shown in FIG. 13, a railroad car wheel counting assembly 144 extends outwardly from the forward end, that is the left end, of the carriage 36 on one end of a cross-bar 146. The assembly 144 preferably includes a protection cover 148, which cover is disposed perpendicular to the cross bar 146.

Figure 14:
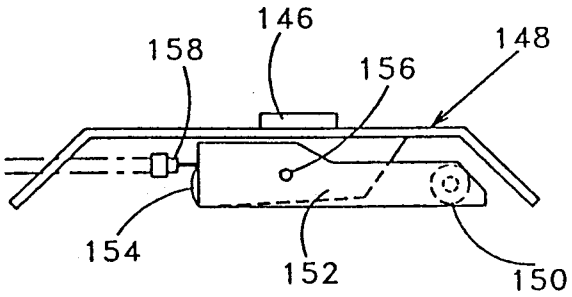
FIG. 14 is a detailed elevational view of the wheel counter mechanism shown in FIG. 13, taken along the line XIV—XIV thereof.

As shown in FIG. 14, the counting assembly 144 preferably comprises a downwardly displaceable wheel 150 mounted on one end of a pivoting cam 152. The pivoting cam 152, which has a bevelled surface 154 at one end, pivots about a pin 156. Additionally, a limit switch 158 is disposed near the bevelled surface 154 of the pivoting cam 152.

Figure 15:
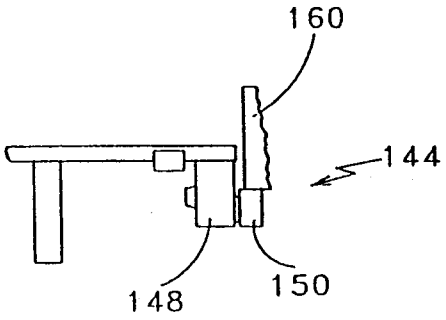
FIG. 15 is an end elevational view of the wheel counting assembly shown in FIG. 13, taken along the line XV—XV thereof, with the addition of a railroad car wheel activating the counter mechanism.

FIG. 15 shows the displaceable wheel 150 of the counting assembly 144 in relation to part of a railroad car wheel 160 positioned directly above the displaceable wheel 150.

Figure 16:
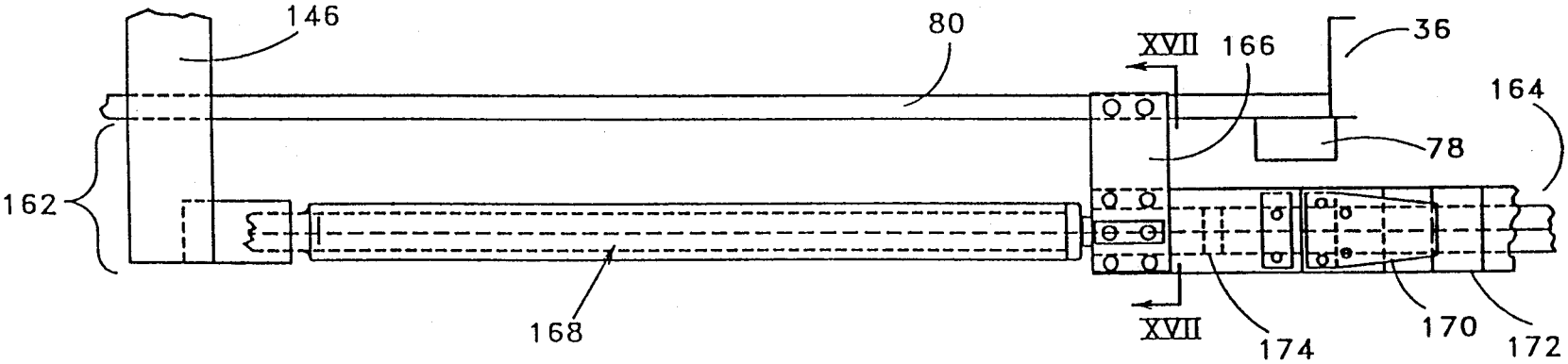
FIG. 16 is a partial plan view of the carriage assembly, showing an electrical power and control cable assembly provided thereon.

Also positioned on the carriage assembly 36, as shown in FIG. 16, on the side opposite that containing the counting assembly 144, is an electric power and control cable assembly 162 for leading electrical cables 164 into the carriage assembly 36. The assembly 162 is preferably supported on the side of the carriage assembly 36 by the cross-bar 146 located at the forward end of the carriage assembly 36 and an arm 166 located at the reverse end of the carriage assembly. A wireway 168, disposed substantially parallel to the side bar 80 of the carriage assembly 36, runs between the outermost portions of the cross-bar 146 and the arm 166. Additionally, a mounting bracket 170 is disposed at the protruding end of the arm 166.

A power chain 172, discussed in more detail below, carries the cables 164 and terminates at the mounting bracket 170. The cables 164 then continue, through a cable connector 174 and the wireway 168. From there, the cables 164 enter the carriage assembly 36.

Figure 17:
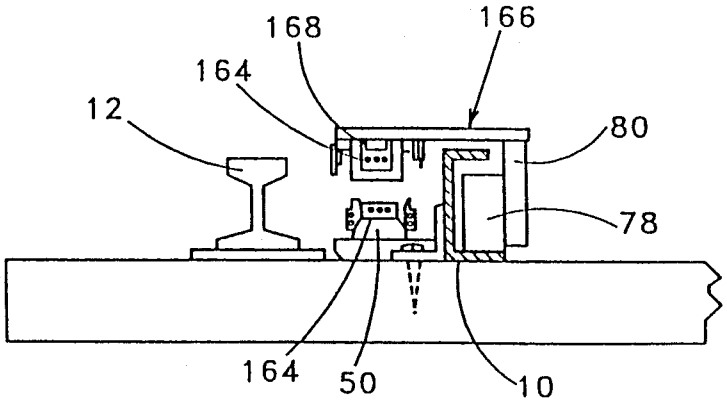
FIG. 17 is an end elevational view, taken along the line XVII—XVII shown in FIG. 16.

As shown in FIG. 17, the wireway 168 is supported alongside one guide track of the guide way 10 and over the cable tray 50, wherein part of the power chain 172 lies. Such a power chain 172 and cable tray 50 are commercially available from the Gleason Reel Corp. of Mayville, Wis. under the name "Powertrak", as well as from other vendors.

Figure 18:
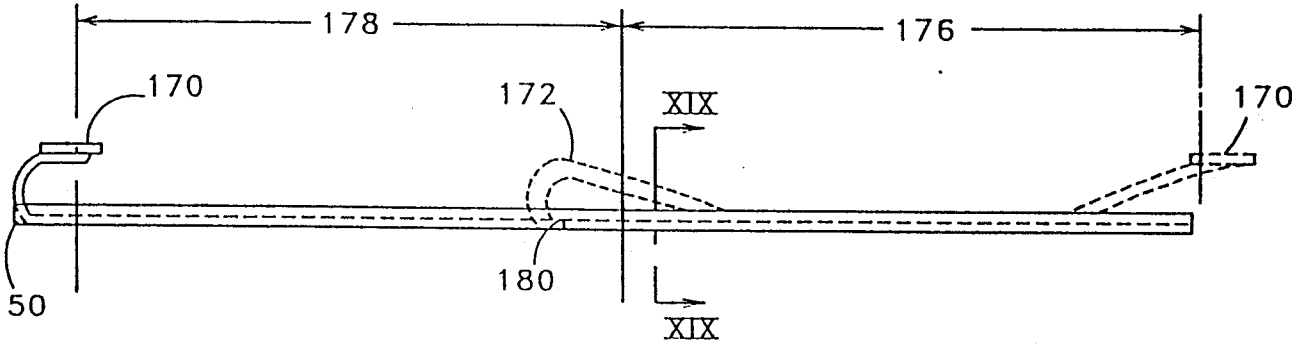
FIG. 18 is an elevational view of a flexible power chain and an associated cable tray therefor.

FIG. 18 shows the positioning of the power chain 172 in relation to the cable tray 50. It may be seen here that the cable tray 50 preferably includes two sections 176 and 178, preferably of equal length.

The power chain 172 is provided to allow the electrical cables 164 to travel with the carriage assembly 36 and to eliminate any physical problems which may otherwise be associated with collecting and paying out the cables 164 during travel of the carriage assembly 36. Consequently, the chain 172 is of an appropriate length to be paid out or collected from the cable tray 50 as the carriage assembly 36 moves in either direction. At the midpoint of the tray 50, the chain 172 terminates at a stationary mounting bracket 180, whence the cables 164 go out through the bottom of the cable tray 50 and to the junction box 52 as shown in FIG. 1B. As mentioned above, the other end of the chain 172 terminates at the movable mounting bracket 170 mounted on the carriage assembly 36.

When the carriage assembly 36 is at one end of its extent of travel, the power chain 172 housing the cables 164 is completely uncoiled. At this point, most of the power chain 172 lies flat in the cable tray 50, except for the end mounted on the carriage mounting bracket 170, where the power chain 172 is bent in the manner of a hairpin in order to meet the carriage mounting bracket 170. As the carriage 36, along with the movable mounting bracket 170, moves towards the opposite carriage travel end, an increasingly greater length of the power chain 172 doubles back on itself and settles into the tray 50.

Figure 19:
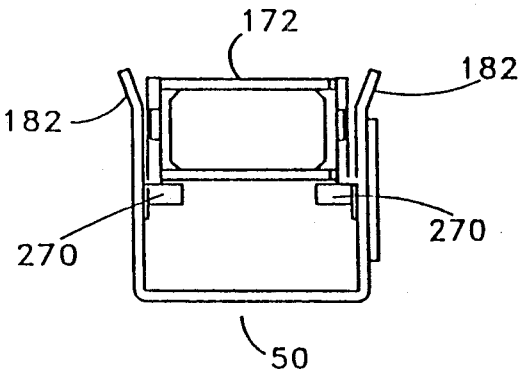
FIG. 19 is a cross-sectional view of the flexible power belt and cable tray of FIG. 18, taken along the line XIX—XIX thereof.

FIG. 19 is an elevational cross-sectional view of the section 176 of the cable tray 50. The cable tray 50 has kick angles 182 to aid in the positioning of the power chain 172. When the power chain 172 settles into section 176 of the tray 50, the power chain rests and slides on support angles 270.

OPERATOR'S PANEL

Figure 20A:
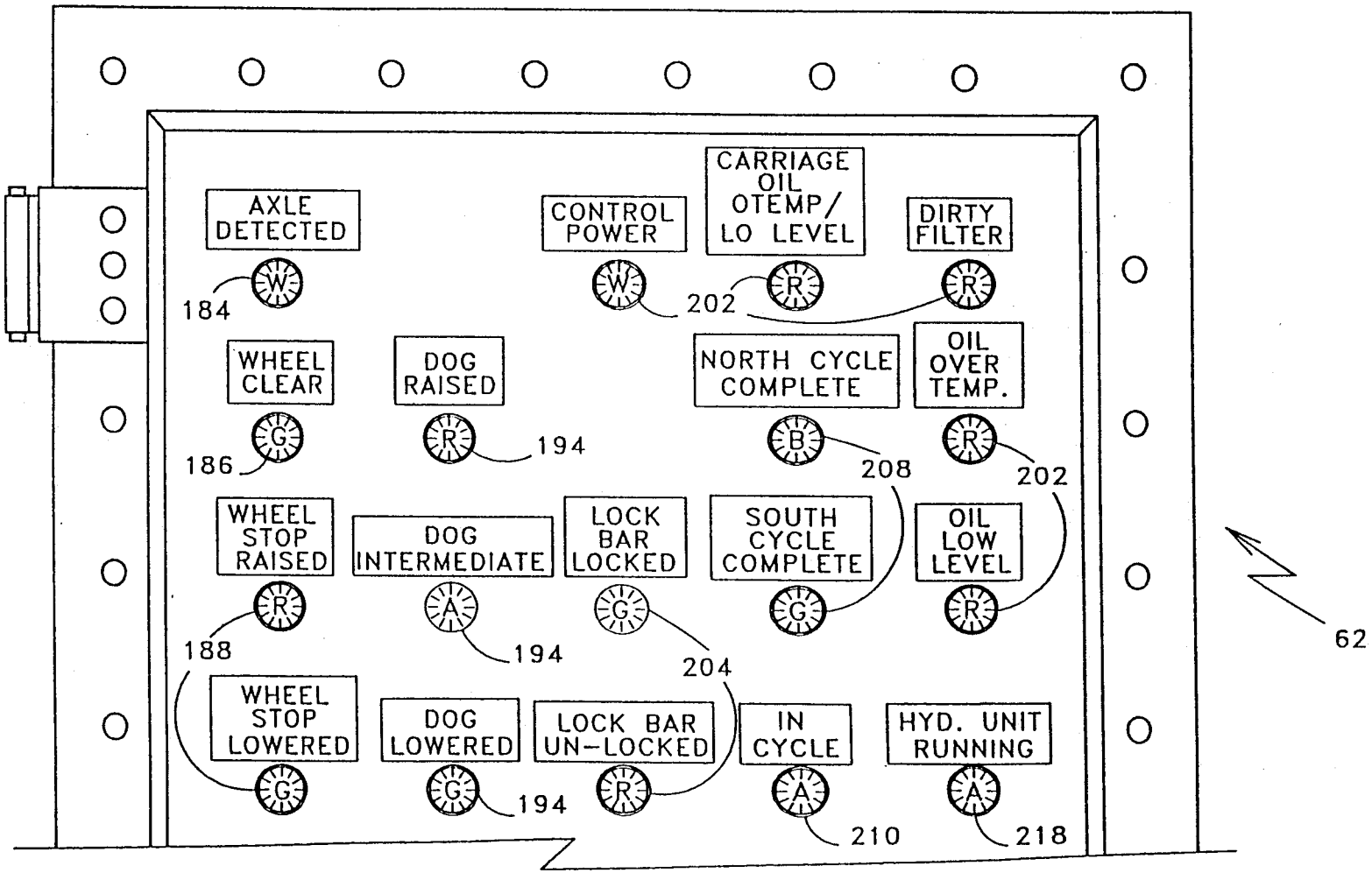
FIGS. 20A, 20B and 20C are elevational views of successive portions of an operator's panel arrangement.
Figure 20B:
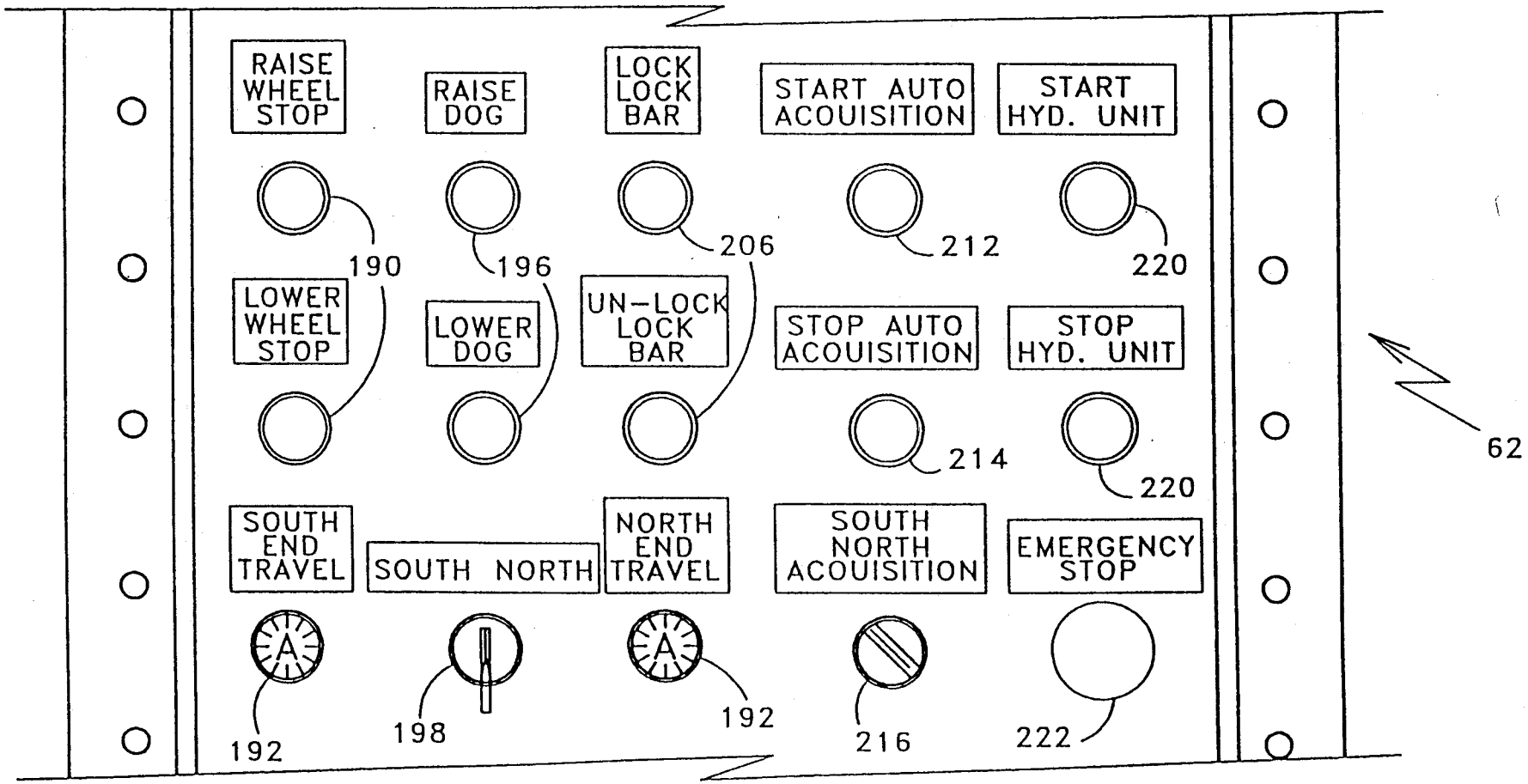
Figure 20C:
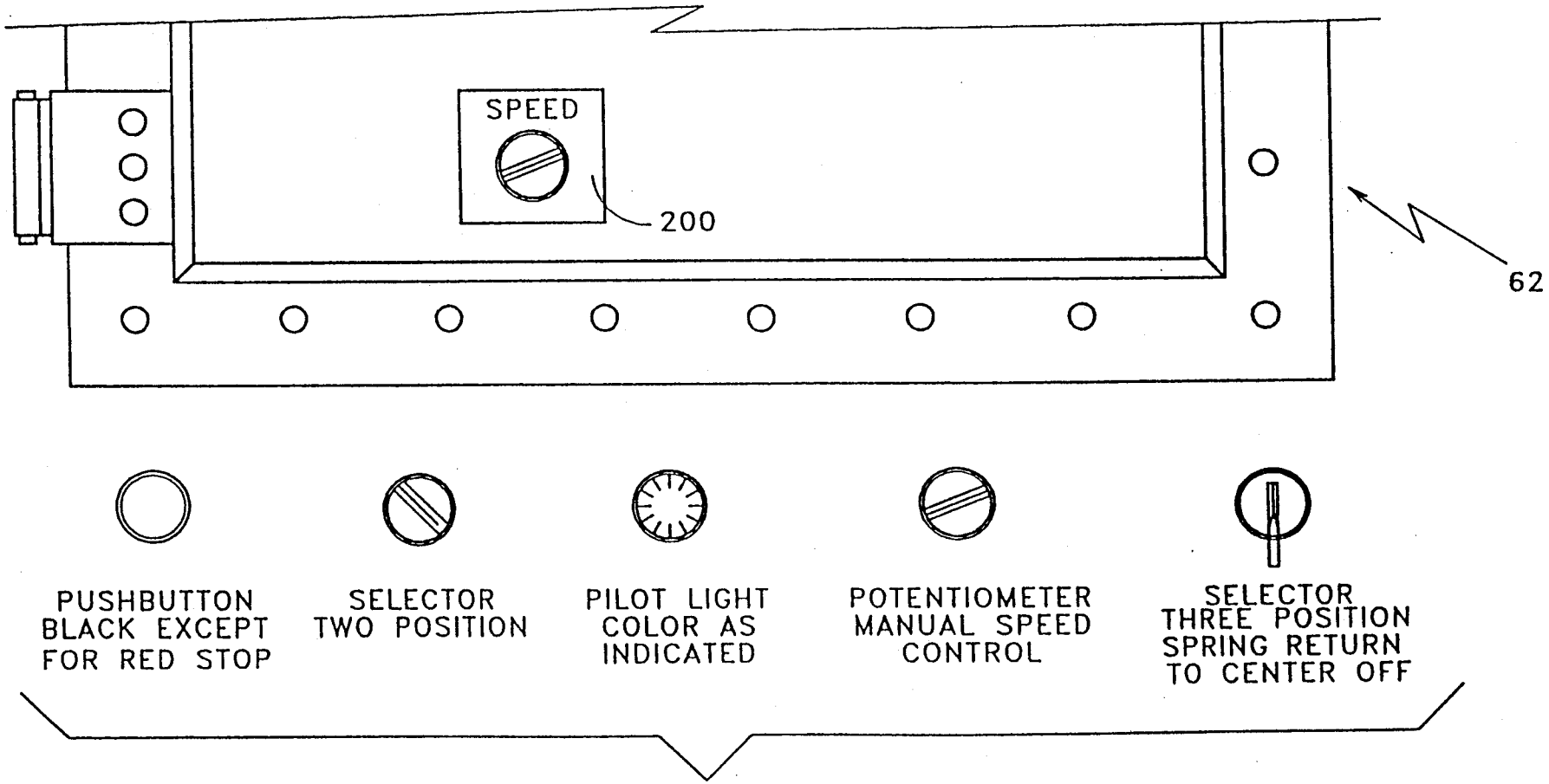

FIGS. 20A, 20B and 20C show a preferred arrangement of an operator's panel 62, which may be used for both manual and automatic operation of a railroad car positioner according to the present invention. Buttons for manual operation include start and stop buttons 220 for the hydraulic drive unit 30. A control 198, which is preferably in the form of a selector switch, activates forward or reverse travel, and a potentiometer 200 controls the speed of travel. Additionally, the pusher dogs 88 and 90 are raised and lowered by means of buttons 196, and the locking bar assembly 110 and 112 is activated and deactivated by buttons 206. An indicator light 218 indicates activation of the hydraulic power unit, lights 192 indicate when the carriage assembly 36 has reached the limit of its travel in the two opposing directions of travel, and lights 194 and 204 indicate the positional status of the dogs 88 and 90 and the lock bar 112, respectively.

Controls for the automatic acquisition of a railroad car axle include a selector switch 216, for the direction of acquisition, and an acquisition cycle start button 212. Additionally, an acquisition cycle stop switch 214 may be used to interrupt the acquisition cycle at any time. An indicator light 210 indicates activation of the cycle sequence, and indicator lights 208 indicate the completion of a cycle in a particular direction of travel. An indicator light 184 is activated when the wheel counting assembly 144, on the carriage 36, detects a railroad car wheel.

Further, the operator's panel 62 preferably includes indicator lights 202, for indicating the status of the control panel power, the carriage assembly oil level and temperature, the carriage assembly oil filter, and the hydraulic power unit oil level and temperature. A large emergency stop button 222 is preferably provided for shutting down all power. An indicator light 186 illuminates in response to activation of either the wheel clear limit switch 44 or wheel detector limit switch 40 as shown in FIG. 1B. Finally, in an embodiment of the invention which includes wheel stops 48 (See FIG. 1B), buttons 190 for the lowering and raising of the wheel stops 48 may be provided, as well as indicator lights 188, for indicating the positional status of the wheel stops 48. All circuitry is appropriately wired from the controls and lights to appropriate parts of the embodiments of the invention described herein, and this circuitry defines appropriate means for carrying out the functions to be performed by the apparatus as described herein.

CONTROL CIRCUITRY

Figure 21:
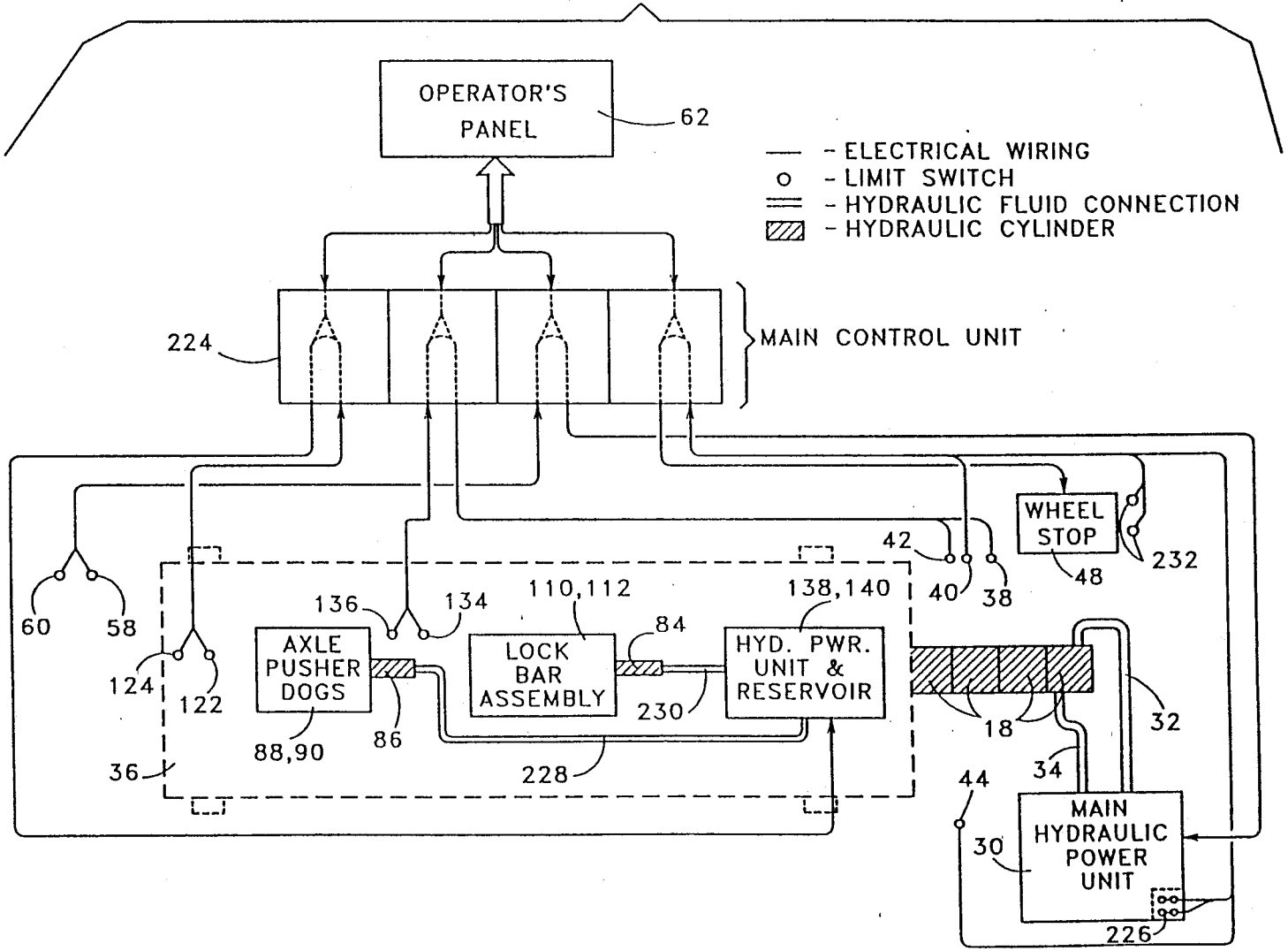
FIG. 21 is a schematic block diagram depicting various components of electrical and hydraulic control systems employed in the present invention.

FIG. 21 is a simplified schematic diagram of the preferred electrical control circuitry and the main hydraulic fluid connections utilized in the present invention. In general, a main control unit 224 serves as a nucleus for the processing, receiving, and transferring of electrical information. Included within the main control unit 224 are motor starters, circuit breakers, and, preferably, an industrial programmable logic controller (or "PLC"). The operator's panel 62, as mentioned earlier, sends commands from the operator in the form of electrical signals to the main control unit 224, whence the signals are processed and routed to the appropriate destinations. Conversely, signals sent from various sensors throughout the apparatus activate appropriate controls in the main control unit 224, and also activate appropriate indicator lights at the operator's panel 62.

Communication from the main control unit 224 to the hydraulic power unit 30 includes electrical means for starting and stopping the power unit 30, and for controlling the rate and direction of hydraulic fluid flow therefrom or thereto.

The fluid connections 32 and 34 from the power unit 30 to the hydraulic cylinders 18 actuate either forward or reverse motion of the carriage assembly 36. Preferably, at least a pair of limit switches 226 disposed at various locations within the power unit 30 serves to indicate the status of the internal components of the power unit 30 by the activation of the appropriate indicator lights 202 on the operator's panel 62, as shown in FIGS. 20A, 20B and 20C, and as was discussed earlier. Additionally, the limit switches 226 provide for a shutting down of the power unit 30, in the event that a given control limit, such as the fluid reservoir level, has been exceeded.

The creep limit switches 42 and 58 provide for deceleration of the carriage assembly 36 by signalling the control unit 224 and the hydraulic power unit 30 to supply less hydraulic fluid to the hydraulic cylinders 18. Likewise, the end travel limit switches 38 and 60 are provided to completely stop motion of the carriage assembly 36, by signalling the control unit 224 and the hydraulic power unit 30 to completely cease supplying the hydraulic cylinders 18 with hydraulic fluid.

Communication from the main control unit 224 to the axle pusher dogs 88 and 90, and to the lock bar assembly 110 and 112, includes electrical means for controlling the hydraulic pump 140 and the hydraulic reservoir 138 of the carriage assembly 36, to achieve results similar to those discussed immediately above for the main hydraulic power unit 30. Therefore, the control unit 224, by way of the carriage hydraulic pump 140, is able to control the rate and direction of hydraulic fluid flow from or to the carriage hydraulic reservoir 138. A hydraulic fluid connection 228 supplies hydraulic fluid to the axle dog hydraulic cylinder 86, and another hydraulic fluid connection 230 supplies hydraulic fluid to the lock bar hydraulic cylinder 84. Both hydraulic cylinders 86 and 84 are, therefore, then able to actuate motion of the axle dogs 88 and 90 and of the lock bar assembly 110 and 112, respectively, in a manner described in more detail below.

The limit switches 122, 123 and 124 indicate the positions of the axle dogs 88 and 90, and the limit switches 134 and 136 indicate the positioning of the lock bar 110. The limit switches 122, 123 and 124 also serve to stop movement of the axle dogs 88 and 90 and, likewise, the limit switches 134 and 136 also serve to stop movement of the lock bar assembly 110 and 112.

As mentioned above, one preferred embodiment of the invention may include at least one retractable wheel stop 48, for preventing any drift of a railroad car. In such a case, communication from the main control unit 224 to the wheel stop 48 preferably includes electrical means for lowering and raising the wheel stop 48. Additionally, position limit switches 232 are preferably provided to detect the position and cease the movement of the wheel stop 48. The position of the wheel stop 48, as detected by the limit switches 232, activates the appropriate indicator light 188 on the operator's panel 62 (See FIGS. 20A, 20B and 20C). Further, the wheel detector limit switch 40, which is situated between the creep limit switch 42 and the end travel limit switch 38 at the reverse travel end 28 of the guide way 10 is preferably actuated by a cam provided on the carriage assembly 36. Also, the wheel clear limit switch 44, which is situated on the opposite side of guide way 6 from wheel detector limit switch 40, is actuated by a railroad car wheel flange, when the carriage assembly 36 is moving a railroad car. Both limit switches 40 and 44 are used to detect wheel clearance for the wheel stop 48 to be raised or lowered. Either limit switch 40 or 44, when activated, will illuminate the "wheel clear" indicator light 186 on the operator's panel 151 (See FIGS. 20A, 20B and 20C).

As mentioned above, the control circuitry of the main control unit 224 is programmable. This implies that the control circuitry may be programmed and customized in a way that best suits the needs of the user. In one preferred embodiment, the control circuitry 224 is preferably a "SLC 150" industrial programmable controller.

OPERATION

In operation of the railroad car positioner according to the present invention, it is first assumed that a string of railroad cars has been positioned on the railroad track such that at least the first car slated for acquisition is located at a point within the travel range of the carriage assembly 36. For manual acquisition of an axle 100, the carriage assembly 36 must first be moved to a position, as shown in FIG. 6, under the axle 100 desired for acquisition. Preferably, the axle 100 desired for acquisition will be either the first or third axle of the railroad car.

Referring now to FIG. 2, if such acquisition requires forward motion of the carriage assembly 36, then a quantity of pressurized fluid is delivered from the hydraulic power unit 30 by way of the fluid connection 32 to the blind end of the anchor cylinder 22. Such fluid delivery actuates outward extension of the piston rod 68 of the anchor cylinder 22.

If acquisition of an axle 100 requires reverse motion of the carriage assembly 36 then, as seen in FIG. 3, a quantity of pressurized fluid is delivered from the hydraulic power unit by way of the fluid connection 34 to the rod end of the anchor cylinder 22. Such fluid delivery then actuates retraction of the piston rod 68 of the anchor cylinder 22.

Figure 22:
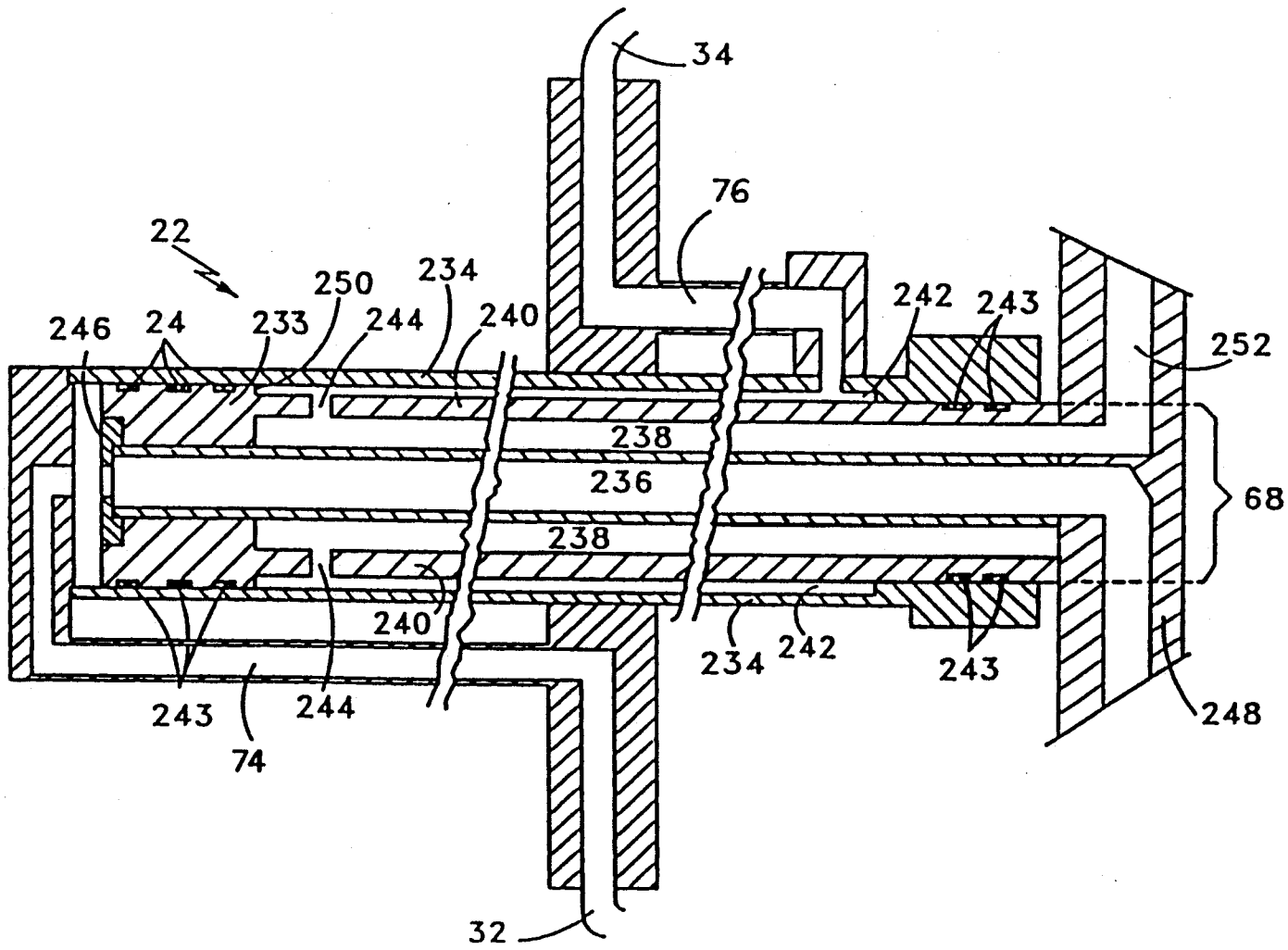
FIG. 22 is a cross-sectional plan view of one of the hydraulic power cylinders of the linear system of hydraulic power cylinders shown in FIG. 2.

Referring now to FIG. 22, it will be seen that one hydraulic cylinder of the series of hydraulic cylinders 18 includes a piston 233 positioned within an outer cylinder wall 234. The piston rod 68 (see FIG. 2) comprises a central cylindrical chamber 236, a concentric annular chamber 238 and an outer wall 240. The space between the piston rod wall 240 and the cylinder wall 234 forms an outer annular chamber 242. A plurality of sealing rings 243 are circumferentially disposed within the outside perimeter of the piston 233. Other sealing rings are disposed about the end of the piston rod wall 240 at the end opposite the piston 233. Finally, at least one orifice 244 is disposed through the piston rod wall 240 and permits the flow of hydraulic fluid between the piston rod annular chamber 238 and the outer annular chamber 242. It should be noted that the chambers 236, 238 and 240 are filled with hydraulic fluid at all times.

For forward motion or extension of the piston rod 68, a quantity of hydraulic fluid is caused to flow through the blind end fluid connection 32 to the central cylindrical chamber 236. As part of this action, a certain quantity of fluid presses against an annular surface 246 indented in the piston 233, thereby causing the piston head 233, and therefore the piston rod 68, to move forward. At the other end of the piston rod 68, a quantity of hydraulic fluid continues through a hydraulic fluid connection 248 to the next cylinder. Additionally, the forward movement of the piston 233 causes the size of the outer annular chamber 242 to decrease and thereby forces hydraulic fluid in the outer annular chamber 242 to flow out of the cylinder 22 through the fluid connection 34 back to the hydraulic power unit 30 (See FIG. 1A).

For reverse motion or retraction of the piston, a quantity of hydraulic fluid is caused to flow through the rod end fluid connection 34 to the piston rod annular chamber 242. The incoming fluid then presses against an annular surface 250, thereby causing the piston 233, and therefore the piston rod 68, to move rearward. At the other end of the piston rod 68, a quantity of hydraulic fluid continues through a hydraulic fluid connection 252 to the next cylinder. Additionally, the rearward movement of the piston 233 causes a quantity of hydraulic fluid to flow out of the cylinder 22 through the fluid connection 32 back to the hydraulic power unit 30 (See FIG. 1A).

It should be understood that the process of extending and retracting the piston 68 in an intermediate cylinder or in the carriage cylinder 26 is substantially similar to the process described above. The main difference in this regard is that the intermediate cylinders 24 and the carriage cylinder 26 are supplied with hydraulic fluid not by the hydraulic fluid connections 32 and 34, but by the connecting hoses 74 and 76 which connect the cylinders 18 in series (See FIG. 2).

Fundamentally, automatic acquisition of a railroad car axle 100 (See FIG. 6) is carried out in much the same way as that of manual acquisition, the primary difference being a procedure for automatic location of the railroad car axle 100 to be acquired. Activation of the automatic acquisition cycle start button 212 on the operator's panel 62 (See FIGS. 20A, 20B and 20C) initiates an automatic, pre-programmed sequence of actions to be carried out by the railroad car positioner. Preferably, the cycle of automatic acquisition is initiated only if an axle 100 has already been acquired manually. Subsequently, primarily in reference to FIG. 4, the sequence of actions making up the automatic acquisition cycle preferably comprises the steps of: returning the lock bar 112 to its rest position; lowering the dogs 88 and 90; actuating motion of the carriage assembly 36 in the direction desired; counting four wheels by means of the counting assembly 144; stopping motion of the carriage assembly 36 at the fourth axle; and grasping the axle 100 by raising the dogs 88 and 90 first to their intermediate position (See FIG. 7) and then, as described earlier, to their raised position (See FIG. 5); and re-activating the lock bar 110. The fourth axle, in either direction from the previous axle acquired, is generally preferably chosen in the automatic acquisition cycle because it occupies the same relative position on an adjacent railroad car as the position occupied by the previous axle acquired on the previous railroad car.

Referring now to FIGS. 14 and 15, as the counting assembly 144 passes under a railroad car wheel 160, the counting wheel 150 is displaced downwardly, causing the cam 152 to pivot. This pivoting motion causes a bevelled surface 154 on the opposite end of the cam 152 to engage the limit switch 158. In addition to producing signals to count the number of railroad car wheels 160, the limit switch 158 also produces an electrical signal which activates the "axle detected" indicator light 184 on the operator's panel 62 (See FIGS. 20A, 20B and 20C). Once the appropriate number of railroad car wheels 160 (and, therefore, axles) has been counted, motion of the carriage assembly 36 is terminated.

The disclosure now turns to aspects of the operation of the railroad car positioner, once the carriage assembly 36 has been positioned under the axle 100 desired for acquisition. FIG. 9 shows a simplified overview of the preferred system of limit switches used in association with the axle pusher dogs 88 and 90. In general, the plunger 130, extending from one reverse dog 90 back towards the limit switches 122 and 124, is disposed so as to be displaced in response to movement of the forward dogs 88. Such a displacement of the plunger 130 will then actuate physical deflection of the side push rollers 126 and 128 in a manner described in more detail below. With the dogs 88 and 90 in their fully lowered position, the plunger 130 is not in contact with either of the switches 122 or 124.

As shown in FIG. 7, the cable 102 is connected to an intermediate point 108 along the length of the forward dogs 88. The axle dogs 88 and 90 are therefore pulled up into their intermediate position as the piston 106 retracts back into the cylinder 86 and pulls on the cable 102. The dogs 88 and 90 are preferably arranged such that, initially, the forward dogs 88 are raised independently of the reverse dogs 90. However, once the forward dogs 88 have been raised adequately to afford a required angular separation between the forward dogs 88 and the reverse dogs 90, the pivot pin 94 engages the side of the hole 120 (See FIG. 8). Subsequently, the forward dogs 88 and reverse dogs 90 move in tandem, maintaining a constant angle of separation. The axle dogs 88 and 90 are held in the intermediate position to allow the reverse dog 90 to move under the axle 100.

Referring now to FIG. 9, as the dogs 88 and 90 are raised into their intermediate position, the plunger 130 is pushed rearward to contact side push roller 126, pushing in the roller 126 to contact the limit switch 122. The limit switch 122 thereby produces an electrical signal which activates the appropriate dog position indicator light 194 at the operator's panel 62 (See FIGS. 20A, 20B and 20C).

Now, referring again to FIG. 7, with the dogs 88 and 90 in their intermediate position, the carriage assembly 36 moves forward under the axle 100. The forward dog 88 then comes into contact with the axle 100. Through continued forward motion of the carriage assembly 36, the tandem ensemble of the forward dogs 88 and reverse dogs 90 pivots about the contact point of the forward dogs 88 and the axle 100. Consequently, as may be seen in FIG. 5, the reverse dogs 90 are caused to raise to a level equal with that of the forward dogs 88. At this point, either the forward dogs 88 or the reverse dogs 90 are in a position to come into contact with the axle 100 and, therefore, to move the railroad car. During the transition of the dogs 88 and 90 from the intermediate position to the fully raised position, the cable 102, initially taut, becomes slack.

Also, as can be seen in FIG. 9, while the dogs 88 and 90 are being raised into their fully raised position, the plunger 130 is pushed further rearward, allowing the side push roller 126 to return to its original protruding position. The plunger 130 then contacts the side push roller 128, pushing in the roller 128 into contact with the limit switch 124. The limit switch 124 thereby produces a signal which activates the appropriate dog position indicator light 194 at the operator's panel 52 (See FIGS. 20A, 20B and 20C).

Referring now to FIG. 4, with the dogs 88 and 90 in their fully raised position, a piston rod 254, extending from the cylinder 84, pushes the ensemble of the locking slide 112 and the lock bar 110 along the pair of inclined ramps 116 and 118 mounted on the carriage assembly side bars 80. Motion of the lock bar 110 stops at a locking position in the notch 114 in the reverse dogs 90. Conversely, retraction of the piston 254 back into the cylinder 84 causes the lock bar 110 to move from its locking position back into a retracted position at the forward end of the carriage assembly 36.

As shown in FIG. 11, when the lock bar 110 is in its retracted position, the limit switch 134 is engaged by an arm 256 of the locking slide 112. As the lock bar 110 is moved rearward by the locking slide 112, the limit switch 134 is released. When the lock bar 110 reaches its locking position, another arm 258 of the locking slide 112 engages the limit switch 136. Each of the limit switches 134 and 136 produces an electrical signal, which signals serve both to cease motion of the lock bar 110 and to activate the appropriate lock bar position indicator light 204 at the operator's panel 62 (See FIGS. 20A, 20B and 20C).

With the axle pusher dogs 88 and 90 in their raised position around axle 100, as shown in FIG. 5, the forward dogs 88 are then able to effect a forward motion of the railroad car and the reverse dogs 90 are able to effect a reverse motion of the railroad car, both upon appropriate motion of the carriage assembly 36. Depending on the distance that the axle 100 is positioned above the carriage assembly 36, either or both of the upper rollers 96 and the lower rollers 98 will remain in physical communication with the railroad car axle 100 as the railroad car is being moved.

Once the railroad car has been moved to its desired destination, the dogs 88 and 90 are returned to their lowered, resting position. Typically, the lock bar 110 and locking slide 112 return to their retracted positions. Then, the carriage assembly 36 moves in reverse and, conversely to the procedure for grasping an axle 100 described above, the dogs 88 and 90 are then able to return to their intermediate position. Finally, the dogs 88 and 90 are lowered back into their original, fully lowered position.

Referring once again to FIG. 9, as the dogs 88 and 90 are lowered, the plunger 130 moves back towards its original resting position, thereby releasing the side push roller 128, pushing in the side push roller 126, and releasing the side push roller 126. When the dogs 88 and 90 are fully lowered, the limit switch 123 is activated by the lever 125 and an electrical signal is produced which activates the appropriate indicator light 194 at the operator's panel 62 (See FIGS. 20A, 20B and 20C).

It will be appreciated from the description of the carriage 36, set forth above, that the carriage 36 is a self-contained unit having its own hydraulic pump with a motor 140 and hydraulic fluid reservoir 138. All of the switches, solenoids, etc. which are provided in the carriage 36 are in electrical communication with the main control unit 224 which, as noted above, preferably includes a programmable logic controller (i.e., a "PLC") which has been programmed, by means well understood by those of ordinary skill in the art, to provide the functional operation detailed herein. Additionally, all of the switches, controls, indicator lights, etc. provided on the operator's panel 62 are in electrical communication with the main control unit 224 and the PLC contained therein.

In the embodiment described above, the operator controls the speed and direction of movement of the carriage 36 via a selector switch 198 (for selecting either forward or reverse movement) and a potentiometer 200 (for controlling the speed of movement of the carriage 36). Alternatively, a so-called "joystick" control could be employed to the same effect. In such case, the speed of the carriage 36, from zero to maximum, would preferably be a function of the deflection of the joystick handle from its zero point, and the direction of movement of the carriage 36 would depend upon the direction of such deflection (e.g., up vs. down or right vs. left).

When the apparatus is placed in the "auto acquisition" mode described above, the direction selector switch 198 and the potentiometer 200 (or, alternatively, the joystick) and all other of the operator's controls (excepting the emergency stop button 222 and the automatic acquisition cycle stop button 214) are deactivated, and the movement of the carriage 36 is then controlled by the PLC included within the main control unit 224.

As discussed above, the "auto acquisition" cycle is initiated with the carriage 36 locked onto an axle of a railroad car. In a particularly preferred embodiment of the invention, the PLC provided in the main control panel 224 is appropriately programmed so as to allow movement of the carriage 36, selectively, at any one of four preselected speeds, for example, a fast forward speed, a slow forward speed, a fast reverse speed and a slow reverse speed. In this embodiment, upon depression of the "start automatic acquisition" button 212, the carriage 36 moves at a "forward slow" speed to remove pressure from the lock bar 110. The lock bar 110 is then retracted, and the carriage 36 moves, at "reverse slow" speed, to rotate the dogs 88 and 90 to the "intermediate" position described above. The carriage 36 then stops, and the dogs 88 and 90 are retracted to their "fully lowered" positions. Thereafter, the carriage 36 then travels, at a "fast" speed in the appropriate direction (either forward or reverse). As each wheel of the railroad car is passed, the "axle detected" light 184 is illuminated, and the PLC provided in the main control panel counts the axles which have been thus detected. In this preferred embodiment of the invention, once a third axle has been detected and passed, the PLC then shifts the carriage 36 to a "slow" speed and stops the carriage 36 at the fourth axle from the previous positioning of the carriage 36. The PLC then raises the dogs 88 and 90 to their "intermediate" positioning as described above. The PLC then causes the carriage 36 to move at the "forward slow" speed to erect the dogs 88 and 90 to the fully "raised" position described above. At this point, the PLC causes the lock bar 110 to engage and lock the dogs 88 and 90 on opposing sides of the newly acquired axle, and the cycle is complete.

The above process may be modified by causing the PLC to shift the carriage 36 at a "fast" speed all the way to the fourth axle, instead of shifting the speed of the carriage 36 to "slow" once the third axle has been passed.

The four preselected speeds discussed above are preferably adjustable, by appropriate programming of the PLC, as well as understood by those of ordinary skill in the art, to meet various system and environmental requirements.

Preferably, each movement of the carriage 36 is protected by a 5 second start delay, during which time, preferably, a warning device (for example, a horn and/or a flashing light) is activated. Preferably, these warning devices remain energized until all movement of the carriage 36 ceases.

The operator's panel 62 is preferably provided with some type of a "track obstruction" indicator light. Preferably, this indicator light is illuminated any time the dogs 88 and 90 are raised (e.g., are not in their fully lowered position).

A railroad car positioning apparatus constructed according to the invention as described herein offers a number of significant advantages. Among these are the following:

The operator is informed at all times about the status and activities of the apparatus by the indicator lights provided on the operator's panel 62.

The railroad car wheel detector can be provided as either a limit switch which is tripped, or a proximity switch.

Since it detects and counts axles, the apparatus automatically adjusts for railroad cars of differing lengths.

The extent of travel of the carriage 36 is easily adjustable and/or modifiable by changing the number and/or the displacement strokes of the hydraulic cylinders 18.

Since the apparatus is provided with two dogs 88 and 90 which are positionable on opposing sides of a railroad car axle, the apparatus effects a positive positioning of a railroad car and can either start or stop a railroad car or a string of railroad cars.

The apparatus can extend across track scales (e.g., weighing devices) commonly encountered at loading sites.

The apparatus can be employed on, preferably, either the first or third axle of a railroad car.

The apparatus can function under an operator's manual control or in an automatic mode provided by appropriate programming of a commonly available PLC.

The apparatus can be employed to either push or pull railroad cars past a given point, for example, a scale or loading area.

The apparatus can be employed to push railroad cars, without using the lock bar 110 described above. For example, the apparatus can be employed to push railroad cars away from a scale.

It will be further appreciated from the description of the carriage 36 set forth above that all electrical and hydraulic components necessary for the actuation of the mechanical components of the carriage 36 are built into the structure of the carriage 36. It should also be noted that, despite the intricacies of the layout of the electrical and hydraulic components therein, it is still possible to afford a high level of precision and versatility in the control and monitoring of the electrical and hydraulic components, and to do so with minimal difficulty from a remote location. As was described in detail above, these advantages are afforded by the preferred arrangement of the operator's panel 62 and the main control unit 224.

Figure 23:
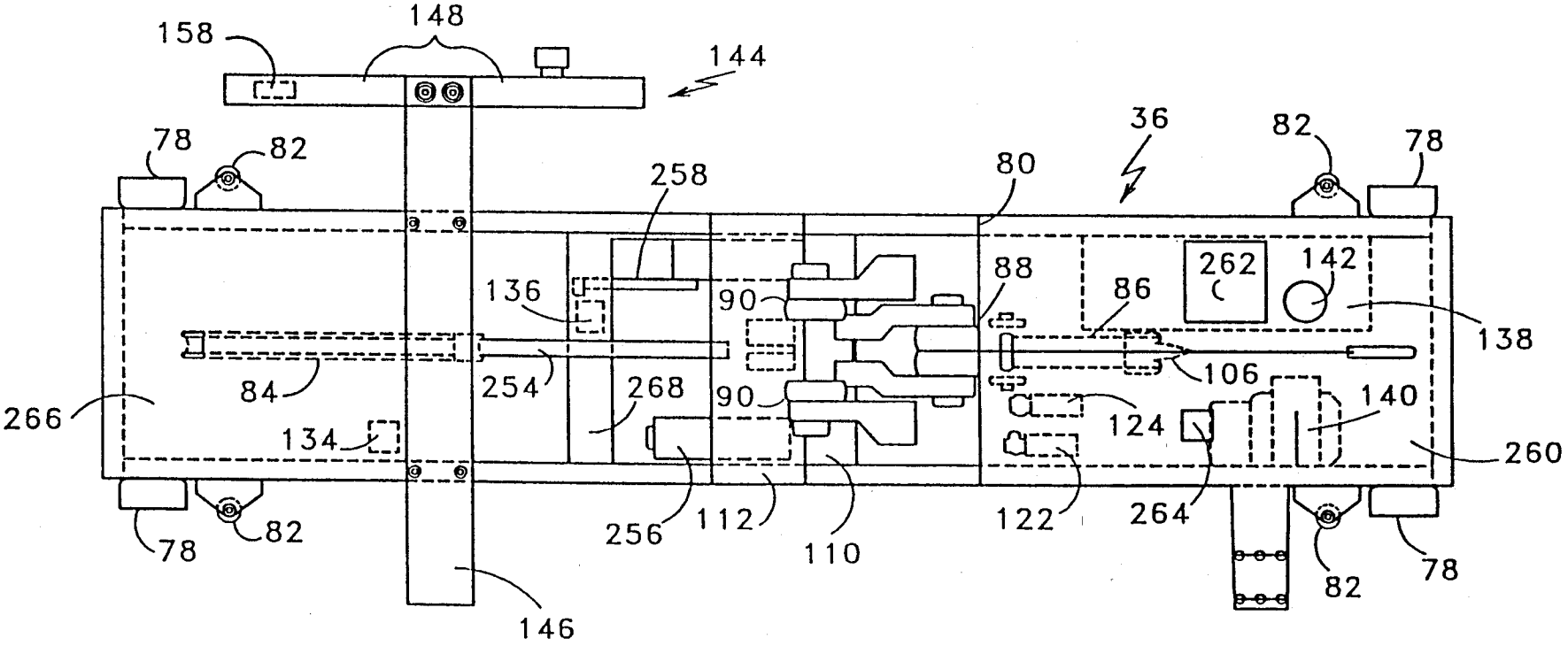
FIG. 23 is substantially the same view as FIG. 4, but showing a set of cover plates disposed upon the carriage assembly.

Additionally, substantially all electrical and hydraulic components of the carriage 36 are covered thereby protected from the environment. A cover plate 260 on the reverse end of the carriage 36, as seen in FIG. 23, shelters the axle dog hydraulic cylinder 86, the hydraulic flow reservoir 138, the carriage hydraulic fluid pump 140 and the axle dog position limit switches 122 and 124. A cover lid 262 and the provided fill cap 142 are disposed to allow access to the hydraulic fluid reservoir 138. Another cover lid 264 allows access to the hydraulic fluid pump 140.

Another cover plate 266 on the forward end of the carriage 36 shelters the lock bar limit switch 134 and the lock bar hydraulic cylinder 84. Additionally, a cross brace 268 shelters the lock bar limit switch 136.

As was discussed earlier, the railroad car wheel counting assembly 144 is preferably provided with the protection cover 148, which cover shelters the limit switch 158 therein.

The reference numerals from one figure are used on other figures and generally have the same significance in the various figures.

All, or substantially all, of the components and methods of the various embodiments may be used with at least one embodiment or all of the embodiments, if any, described herein All of the patents, patent applications and publications recited herein, if any, are hereby incorporated by reference as if set fourth in their entirety herein.

The details in the patents, patent applications and publications may be considered to be incorporable, at the applicant's option, into the claims during prosecution as further limitations in the claims to patentably distinguish any amended claims from any applied prior art.

The invention as described hereinabove in the context of the preferred embodiments is not to be taken as limited to all of the provided details thereof, since modifications and variations thereof may be made without departing from the spirit and scope of the invention.

What is claimed is:

1. A method of acquiring and positioning railroad cars in a train of cars along a railroad track, comprising:

providing a guideway means situated between a pair of rails of the rails of the railroad track;

providing a carriage member for travel along said guideway means and dog means mounted on the carriage member;

providing means for selectively moving the dog means between a lowered position beneath an axle height of the railroad cars to a raised position at the axle height for acquiring an axle of a railroad car;

providing a plurality of axially aligned, double acting hydraulic cylinders, each cylinder having an axially aligned piston rod therein for selectively moving the carriage member in one of a forward or reverse direction along the guideway means as said piston rods are extended or retracted under hydraulic fluid pressure for exerting a force between the dog means and an acquired axle for moving an acquired railroad car a selected distance and for thereafter indexing the carriage member in an opposite direction for acquiring an axle of a next railroad car;

providing means for counting a number of axles passed as the carriage member indexes and means for stopping the carriage member when a predetermined number of axles has been counted;

conducting the steps of:

(a) moving the dog means to the lowered position;

(b) indexing said carriage member along said guideway and counting axles as the carriage member moves past the axles;

(c) stopping said carriage member when a predetermined number of axles has been counted;

(d) moving the dog means to a raised position to acquire an axle of a railroad car;

(e) moving the acquired railroad car a selected distance; and (f) repeating steps (a)-(e) to position other railroad cars.

2. The method according to claim 1, further comprising:

at least one of the following sets a) and b) of steps being performed automatically and in sequence:

a) said step of moving the dog means into the lowered position and said step of indexing the carriage member; and b) said step of stopping the carriage member and said step of positioning the dog means into the raised position.

3. The method according to claim 2, wherein the following steps are performed automatically and in sequence:

said step of moving the dog means into the lowered position;

said step of indexing the carriage member;

said step of stopping the carriage member when the predetermined number of axles has been counted; and said step of moving the dog means into the raised position in preparation for moving the acquired railroad car.

4. The method according to claim 3, wherein:

the dog means comprises a first dog member and a second dog member;

each of the first and second dog members comprising at least one dog;

the first dog member for contacting a portion of the acquired axles;

the second dog member for contacting a substantially opposite portion of the acquired axles;

both of the first and second dog members extending from the carriage member to at least the axle height of the railroad cars in the raised position; and both of the first and second dog members being fully disposed beneath the axle height in the lowered position.

5. The method according to claim 4, further comprising, providing locking means for holding in place at least one of the first and second dog members when one of said dog members is in the raised position.

6. The method according to claim 4, further comprising:

moving the dog meas into an intermediate position between the raised position and the lowered position, wherein one of the first and second dog members extends from the carriage members to at least the axle height and the other of the first and second dog members is substantially fully disposed beneath the axle height.

7. The method according to claim 6, wherein said step of moving the dog means into the intermediate position is performed, automatically:

prior to said step of moving the dog means into the lowered position; and subsequent to said step of stopping the carriage member but prior to said step of moving the dog means into the raised position.

8. The method according to claim 7, further comprising:

providing first limit switch means for:

producing an electrical signal upon movement of the first and second dog members into each of the raised position, the intermediate position and the lowered position; and ceasing the movement of the first and second dog members upon movement of the first and second dog members into each of the raised position, the intermediate position and the lowered position.

9. The method according to claim 8, further comprising:

providing means for effecting substantially independent movement of the first dog member while the first and second dog members are being moved between the intermediate position and the second position.

10. The method according to claim 9, further comprising:

providing means for effecting substantially simultaneous movement of the first and second dog members while the first and second dog members are being moved between the first position and the intermediate position.

11. Apparatus for automatically acquiring and positioning railroad cars in a train of cars along a railroad track; said apparatus comprising:

a guideway means situated between a pair of rails of the railroad track;

a carriage for travel along the guideway means;

dog means mounted on said carriage;

means for selectively moving the dog means between a lowered position beneath an axle height of the railroad cars and a raised position at the axle height for acquiring an axle of a railroad car;

a plurality of axially aligned, double acting hydraulic cylinders, each cylinder having an axially aligned piston rod therein for displacing the carriage in one of a forward or reverse direction along the guideway means as said piston rods are extended or retracted under hydraulic fluid pressure for exerting a force between the dog means and an acquired axle for thereby moving an acquired railroad car a selected distance and for thereafter indexing the carriage in an opposite direction for acquiring an axle of a next railroad car;

means for producing a signal when said carriage is indexed past an axle and for counting the number of axles passed;

means for cumulatively storing a counted number of axles; and means for stopping said carriage when a predetermined number of axles has been counted.

12. The apparatus according to claim 11, wherein said plurality of hydraulic cylinders includes at least one of said hydraulic cylinders being disposed in series with at least another of said hydraulic cylinders.

13. The apparatus according to claim 11, further comprising:

means for performing at least one of the following sets a) and b) automatically and in sequence:

a) positioning said dog means into said lowered position and displacing said carriage member; and b) stopping the displacement of said carriage member and positioning said dog means into said raised position.

14. The apparatus according to claim 13, further comprising means for performing the following steps automatically and in sequence:

positioning the dog means into the lowered position;

displacing the carriage member;

stopping the displacement of the carriage member upon the displacement of the carriage member past the predetermined number of axles; and positioning the dog means into the raised position in preparation for moving the train of at least one railroad car.

15. The apparatus according to claim 14, wherein:

said dog means comprises a first dog member and a second dog member;

each of said first and second dog members comprising at least one dog;

said first dog member for contacting a portion of the acquired axles; and said second dog member for contacting a substantially opposite portion of said acquired axles.

16. The apparatus according to claim 15, wherein:

both of said first and second dog members extend from said carriage member to at least the axle height in the raised position; and both of said first and second dog members being fully disposed beneath the axle height in the lowered position.

17. The apparatus according to claim 16 including locking means for holding in place at least one of said first and second dog members when one of said first and second dog members is in the raised position.

18. The apparatus according to claim 17 wherein said locking means comprises:

a lockbar for holding in place at least one of said first and second dog members when at least one of said first and second dog members is disposed in said first position;

a locking slide being connected to said lockbar; and lockbar displacement means for moving said locking slide and said lockbar, said lockbar displacement means being connected to said locking slide;

said lockbar displacement means comprising a hydraulic cylinder connected to said locking slide;

said lockbar being positionable between:

a locked position, wherein said lockbar holds in place at least one of said first and second dog members when said first and second dog members are disposed in said first position; and an unlocked position, wherein said lockbar is disposed apart from said first and second dog members;

and wherein at least one of said first and second dog members have a notch for receiving said lockbar when said lockbar is in said locked position.

19. The apparatus according to claim 16, further comprising:

means for selectively positioning said dog means into an intermediate position between said raised position and said lowered position, wherein one of said first and second dog members extends from said carriage member to at least the axle height and the other of the first and second dog members is substantially fully disposed beneath the axle height.

20. The apparatus according to claim 19, further comprising:

first limit switch means for producing an electrical signal upon movement of said first and second dog members into each of said raised position, said intermediate position and said lowered position; and said first limit switch means comprising means for ceasing the movement of said first and second dog members upon movement of said first and second dog members into each of said raised position, said intermediate position and said lowered position.

21. The apparatus according to claim 20, wherein said first limit switch means comprises three limit switches.

* * * * *

UNITED STATES PATENT AND TRADEMARK OFFICE

CERTIFICATE OF CORRECTION

PATENT NO. : 5,287,812

DATED : February 22, 1994

INVENTOR(S) : Ernest W. Lobb, Bruce A. Robbins and David L. Depew

It is certified that error appears in the above-indentified patent and that said Letters Patent is hereby corrected as shown below:

Title page, after [75] Inventors:, "W.," should read --W.--.

Column 15 Lines 18-19 "protected" should read --preceded--.

Column 16 Line 11 after "covered" insert --and--.

Claim 6 Line 67 Column 17 "meas" should read --means--.

Claim 6 Line 2 Column 18 "members" should read --member--.

Signed and Sealed this

Fifth Day of July, 1994

*Attest:*

Bruce Lehman

BRUCE LEHMAN

*Attesting Officer*

*Commissioner of Patents and Trademarks*